US006988569B2

(12) United States Patent
Lockstedt et al.

(10) Patent No.: US 6,988,569 B2
(45) Date of Patent: Jan. 24, 2006

(54) CUTTING ELEMENT ORIENTATION OR GEOMETRY FOR IMPROVED DRILL BITS

(75) Inventors: Alan W. Lockstedt, Houston, TX (US); Gary R. Portwood, Kingwood, TX (US); Scott D. McDonough, Houston, TX (US)

(73) Assignee: Smith International, Houston, TX (US)

( * ) Notice: Subject to any disclaimer, the term of this patent is extended or adjusted under 35 U.S.C. 154(b) by 0 days.

(21) Appl. No.: 11/032,320

(22) Filed: Jan. 10, 2005

(65) Prior Publication Data

US 2005/0167162 A1 Aug. 4, 2005

Related U.S. Application Data

(63) Continuation of application No. 10/658,888, filed on Sep. 10, 2003, now Pat. No. 6,848,521, which is a continuation of application No. 09/107,639, filed on Jun. 30, 1998, now Pat. No. 6,640,913, and a continuation-in-part of application No. 08/667,758, filed on Jun. 21, 1996, now Pat. No. 5,833,020, which is a continuation-in-part of application No. 08/630,517, filed on Apr. 10, 1996, now Pat. No. 6,390,210.

(60) Provisional application No. 60/051,302, filed on Jun. 30, 1997.

(51) Int. Cl.
*E21B 10/08* (2006.01)

(52) U.S. Cl. ..... 175/331; 175/374; 175/426

(58) Field of Classification Search ..... 175/331, 175/431, 371, 374, 378, 408, 426
See application file for complete search history.

(56) References Cited

U.S. PATENT DOCUMENTS

| | | | |
|---|---|---|---|
| 1,998,793 | A | 4/1935 | Stancliff |
| 2,117,679 | A | 5/1938 | Reed |
| 2,147,926 | A | 2/1939 | Scott |
| 2,230,569 | A | 2/1941 | Howard et al. |
| 2,663,546 | A | 12/1953 | Kammerer |
| 2,728,559 | A | 12/1955 | Boice et al. |
| 2,815,936 | A | 12/1957 | Peter et al. |
| 2,901,224 | A | 8/1959 | Boice et al. |
| 4,187,922 | A | 2/1980 | Phelps |
| 4,393,948 | A | 7/1983 | Fernandez |
| 4,427,081 | A | 1/1984 | Crawford |
| 4,802,539 | A | 2/1989 | Hall et al. |

(Continued)

FOREIGN PATENT DOCUMENTS

CN 1214135.2 8/1991

*Primary Examiner*—Frank S. Tsay
(74) *Attorney, Agent, or Firm*—Osha Liang LLP

(57) ABSTRACT

A rolling cone drill bit is provided that has gage inserts on the first row from the bit axis to cut to full gage diameter that have a cutting portion enhanced with a layer of super abrasive material. The gage cutting surface has a center axis that is canted to be more normal to the gage curve such that the its point of contact at gage is away from the thinner portion of the layer of super abrasive material.

7 Claims, 18 Drawing Sheets

U.S. PATENT DOCUMENTS 4,815,342 A 3/1989 Brett et al.
4,832,139 A * 5/1989 Minikus et al. ..... 175/374
4,915,486 A 4/1990 Hansen
5,172,777 A * 12/1992 Siracki et al. ..... 175/374
5,197,555 A 3/1993 Estes
5,224,560 A 7/1993 Fernandez
5,351,768 A 10/1994 Scott
5,353,885 A 10/1994 Hooper
5,372,210 A 12/1994 Harrell
5,407,022 A * 4/1995 Scott et al. ..... 175/331
5,415,030 A 5/1995 Jogi et al.
5,479,997 A 1/1996 Scott
5,697,462 A 12/1997 Grimes et al.
5,833,020 A * 11/1998 Portwood et al. ..... 175/331

* cited by examiner

CUTTING ELEMENT ORIENTATION OR GEOMETRY FOR IMPROVED DRILL BITS

RELATED APPLICATION

This application claims the benefit of U.S. Provisional Application No. 60/031,302, filed Jun. 30, 1997 and is a continuation-in-part of U.S. Ser. No. 08/667,758, filed Jun. 21, 1996 Now U.S. Pat. No. 5,833,020 which is a continuation-in-part of U.S. Ser. No. 08/630,517, filed Apr. 10, 1996 Now U.S. Pat. No. 6,390,210.

FIELD OF THE INVENTION

The invention relates to rolling cone drill bits and to an improved cutting structure for such bits. In one aspect, the invention relates to such bits with canted gage cutting inserts.

BACKGROUND OF THE INVENTION

The present invention relates generally to diamond enhanced inserts for use in drill bits and more particularly to diamond enhanced inserts for use in the gage or near-gage rows of rolling cone bits. Still more particularly, the present invention relates to placement of a diamond coating on an insert and to positioning the insert in a cone such that wear and breakage of the insert are reduced and the life of the bit is enhanced.

An earth-boring drill bit is typically mounted on the lower end of a drill string and is rotated by rotating the drill string at the surface or by actuation of downhole motors or turbines, or by both methods. With weight applied by the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. Such bits typically include a bit body with a plurality of journal segment legs. Each rolling cone is mounted on a bearing pin shaft that extends downwardly and inwardly from a journal segment leg. The borehole is formed as the gouging and scraping or crushing and chipping action of the rotary cones remove chips of formation material that are carried upward and out of the borehole by drilling fluid that is pumped downwardly through the drill pipe and out of the bit. The drilling fluid carries the chips and cuttings in a slurry as it flows up and out of the borehole. The earth disintegrating action of the rolling cone cutters is enhanced by providing the cutters with a plurality of cutter elements.

The cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits that will drill faster and longer and are usable over a wider range of formation hardnesses.

The length of time that a drill bit may be employed before it must be changed depends upon its rate of penetration ("ROP"), as well as its durability or ability to maintain an acceptable ROP. The form and positioning of the cutter elements on the cutters greatly impact bit durability and ROP and thus are critical to the success of a particular bit design.

Bit durability is, in part, measured by a bit's ability to "hold gage," meaning its ability to maintain a full gage borehole diameter over the entire length of the borehole. Gage holding ability is particularly vital in directional drilling applications. If gage is not maintained at a relatively constant dimension, it becomes more difficult, and thus more costly, to insert drilling assemblies into the borehole than if the borehole had a constant full gage diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the bit life of the newly-inserted bit, thus prematurely requiring the time-consuming and expensive process of removing the drill string, replacing the worn bit, and reinstalling another new bit downhole.

Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are known as "milled tooth bits." In each case, the cutter elements on the rotating cutters functionally breakup the formation to form new borehole by a combination of gouging and scraping or chipping and crushing. While the present invention has primary application in bits having inserts rather than milled teeth and the following disclosure is given in terms of inserts, it will be understood that the concepts disclosed herein can also be used advantageously in milled tooth bits.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearing and ultimately lead to bit failure.

In addition to the heel row inserts, conventional bits typically include a gage row of cutter elements mounted adjacent to the heel surface but orientated and sized in such a manner so as to cut the comer of the borehole. In this orientation, the gage cutter elements generally are required to cut both the borehole bottom and sidewall. The lower surface of the gage row insert engages the borehole bottom while the radially outermost surface scrapes the sidewall of the borehole. Conventional bits also include a number of additional rows of cutter elements that are located on the cones in rows disposed radially inward from the gage row. These cutter elements are sized and configured for cutting the bottom of the borehole and are typically described as inner row cutter elements.

Differing forces are applied to the cutter elements by the sidewall than the borehole bottom. Thus, requiring gage cutter elements to cut both portions of the borehole compromises the cutter design. In general, the cutting action operating on the borehole bottom is typically a crushing or gouging action, while the cutting action operating on the sidewall is a scraping or reaming action. Ideally, a crushing or gouging action requires a tough insert, one able to withstand high impacts and compressive loading, while the scraping or reaming action calls for a very hard and wear resistant insert. One grade of cemented tungsten carbide cannot optimally perform both of these cutting functions as it cannot be as hard as desired for cutting the sidewall and, at the same time, as tough as desired for cutting the borehole bottom. Similarly, PCD grades differ in hardness and toughness and, although PCD coatings are extremely resistant to wear, they are particularly vulnerable to damage caused by impact loading as typically encountered in bottom hole cutting duty. As a result, compromises have been made in conventional bits such that the gage row cutter elements are not as tough as the inner row of cutter elements because they must, at the same time, be harder, more wear resistant and less aggressively shaped so as to accommodate the scraping action on the sidewall of the borehole.

In FIG. 14 the positions of all of the cutter inserts from all three cones are shown rotated into a single plane. As shown in FIG. 14, to assist in maintaining the gage of a borehole, conventional rolling cone bits typically employ a row of heel cutters 214 on the heel surface 216 of each rolling cone 212. The heel surface 216 is generally frustoconical and is configured and positioned so as to generally align with the sidewall of the borehole as the bit rotates. The heel cutters 214 contact the borehole wall with a sliding motion and thus generally may be described as scraping or reaming the borehole sidewall. The heel cutters 214 function primarily to maintain a constant gage and secondarily to prevent the erosion and abrasion of the heel surface of the rolling cone.

In addition to heel row cutter elements, conventional bits typically include a row of gage cutter elements 230 mounted in gage surface 231 and oriented and sized in such a manner so as to cut the comer of the borehole. For purposes of the following discussion, the gage row is defined as the first row of inserts from the bit axis of a multiple cone bit that cuts to full gage. This insert typically cuts both the sidewall of the borehole and a portion of the borehole floor. Cutting the corner of the borehole entails cutting both a portion of the borehole side wall and a portion of the borehole floor. It is also known to accomplish the corner cutting duty that is usually performed by the gage cutters by dividing it between adjacent gage and nestled gage cutters (not shown) such that the nestled gage cutters perform most of the sidewall cutting and the adjacent gage cutters cut the bottom portion of the corner.

Conventional bits also include a number of additional rows of cutter elements 232 that are located on the main, generally conical surface of each cone in rows disposed radially inward from the gage row. These inner row cutter elements 232 are sized and configured for cutting the bottom of the borehole and are typically described as inner row cutter elements.

An FIGS. 14, 16, 18 20 and 22, the positions of all of the cutter inserts from all three cones are shown rotated into a single plane. As can be seen, the cutter elements in the heel and gage rows typically share a common position across all three cones, while the cutter elements in the inner rows are radially spaced so as to cut the borehole floor in the desired manner. Excessive or disproportionate wear on any of the cutter elements can lead to an undergage borehole, decreased ROP, or increased loading on the other cutter elements on the bit, and may accelerate wear of the cutter bearing and ultimately lead to bit failure.

Relative to polycrystalline diamond, tungsten carbide inserts are very tough and impact resistant, but are vulnerable to wear. Thus, it is known to apply a cap layer of polycrystalline diamond (PCD) to each insert. The PCD layer is extremely wear-resistant and thus improves the life of a tungsten carbide insert. Conventional processing techniques have, however, limited the use of PCD coatings to axisymmetrical applications. For example, a common configuration for PCD coated inserts can be seen in FIGS. 14 and 15, wherein insert 230 comprises a domed tungsten carbide base or substrate 240 supporting a hemispherical PCD coating 242. Inserts of this type are formed by forming a non-reactive container also known as a "can", corresponding to the external shape of the insert, positioning a desired amount of PCD powder in the can, placing the substrate in the can on top of the PCD powder, enclosing and sealing the can, and applying sufficient pressure and temperature to sinter the PCD and adhere it to the substrate. If required, the resulting diamond or substrate layers can be ground into a final shape following demolding.

The shape of PCD layers formed in this manner is based on consideration of several factors. First, the difference in the coefficients of thermal expansion of diamond and tungsten carbide gives rise to differing rates of contraction as the sintered insert cools. This in turn causes residual stresses to exist in the cooled insert at the interface between the substrate and the diamond layer. If the diamond layer is too thick, these residual stresses can be sufficient to cause the diamond layer to break away from the substrate even before any load is applied. On the other hand, if the diamond layer is too thin, it may not withstand repetitive loading during operation and may fail due to fatigue. The edge 261 of the diamond coating is a particular source of stress risers and is particularly prone to failure.

For all of these reasons, PCD coated inserts have typically been manufactured with a hemispherical top, commonly referred to as a "semi-round top" or SRT. Referring again to FIG. 15, the SRT 303 is aligned with the longitudinal axis 241 of the substrate such that its center point lies approximately on axis 241. The inner surface of the diamond coating corresponds to the domed shape of the substrate. Thus, the thickness of the diamond coating is greatest on the axis of the insert and decreases toward the edge of the coating layer. While inserts in which the diamond coating is of uniform thickness are known, e.g. U.S. Pat. No. 5,030,250, it is more common to form a diamond layer that decreases in thickness as distance from the center point increases, resulting in the crescent-shaped cross-section shown in FIG. 15. Nevertheless, it is contemplated that diamond layer 242 can be other than crescent-shaped. For example, the thickest portion of diamond layer 242 could comprise a region rather than a point. The diamond layer typically tapers toward the outer diameter of the substrate (the diamond edge 261). This tapering helps prevent cracks that have been known to develop at the diamond edge when a substantially uniform diamond layer is used.

because of the interrelationship between the shape of each cone and the shape of the borehole wall, cutter elements in the heel row and inner rows are typically positioned such that the longitudinal axes of those cutter elements are more or less perpendicular to the segment of the borehole wall (or floor) that is engaged by that cutter element at the moment of engagement. In contrast, cutter elements in the gage row do not typically have such a perpendicular orientation. This is because in prior art bits, the gage row cutter elements are mounted so that their axes are substantially perpendicular to the cone axis 213. Mounted in this manner, each gage cutter element engages the gage curve 222 at a contact point 243 (FIG. 15) that is close to the thin edge of the diamond coating on the hemispherical top of each cutter element.

Still referring to FIG. 15, the angle between the insert axis 241 and a radius terminating at contact point 243 is hereinafter designated $\alpha$. In prior art bits, the angle $\alpha$ has typically been in the range of 54° to 75°, with $\alpha$ being greater for harder formation types. For example, in a typical 12¼" rock bit, $\alpha$ may be about 57°.

The prior art configuration described above is not satisfactory, however, because contact point 243 is at the edge of diamond layer 242, where the diamond layer is relatively thin, and is subjected to particularly high stresses and is therefore especially vulnerable to cracking and breaking, which in turn leads to premature failure of the inserts in the gage row.

Accordingly, there remains a need in the art for a gage insert that is more durable than those conventionally known and that will yield greater ROP's and an increase in footage drilled while maintaining a full gage borehole. Preferably, the gage insert would also be relatively simple to manufacture.

SUMMARY OF THE INVENTION

In one aspect of the present invention, an earth-boring drill bit for drilling a borehole of a predetermined gage is provided that comprises a bit body having a bit axis and a plurality of rolling cone cutters, each rotatably mounted on the bit body about a respective cone axis and having a plurality of rows of cutting inserts thereon. One of the rows is a gage-row with gage inserts located such that it is the first row of inserts from the bit axis that cuts the predetermined gage and the borehole corner substantially unassisted. The gage inserts have a generally cylindrical base portion secured in the cone and defining an insert axis, and a cutting portion extending from the base portion. The cutting portion comprises a generally convex gage cutting surface with a center axis that is oblique to the cone axis and at least a portion of the gage cutting surface is enhanced with a super abrasive material.

In the present invention the axis of the gage cutting surface of the gage insert is repositioned so that it is more normal to the gage curve and less normal to the cone axis. This decreases the angle $\alpha$ so that the contact point on the gage insert is farther from the edge of the diamond layer, thereby providing a thicker diamond layer at the contact point and enhancing insert life and bit ROP.

BRIEF DESCRIPTION OF THE DRAWINGS

For an introduction to the detailed description of the preferred embodiments of the invention, reference will now be made to the accompanying drawings, wherein:

In FIGS. 14, 16, 18, 20 and 22, the positions of all of the cutter inserts from all three cones are shown rotated into a single plane.

DETAILED DESCRIPTION OF THE PREFERRED EMBODIMENTS

Figure 1:
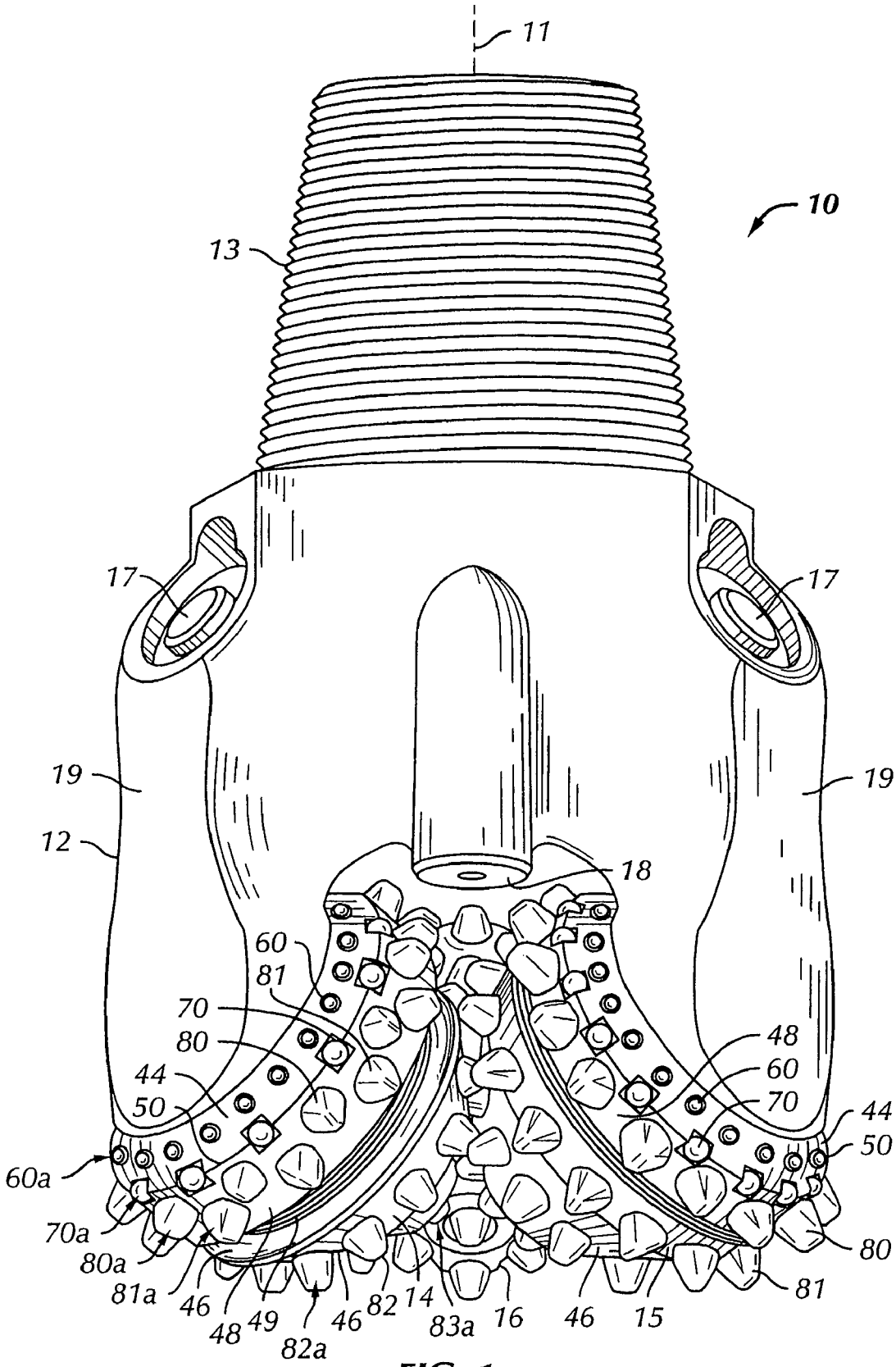
FIG. 1 is a perspective view of an earth-boring bit made in accordance with the principles of the present invention.

Referring first to FIG. 1, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cutters 14–16. Bit 10 further includes lubricant reservoirs 17 that supply lubricant to the bearings of each of the cutters.

Figure 2:
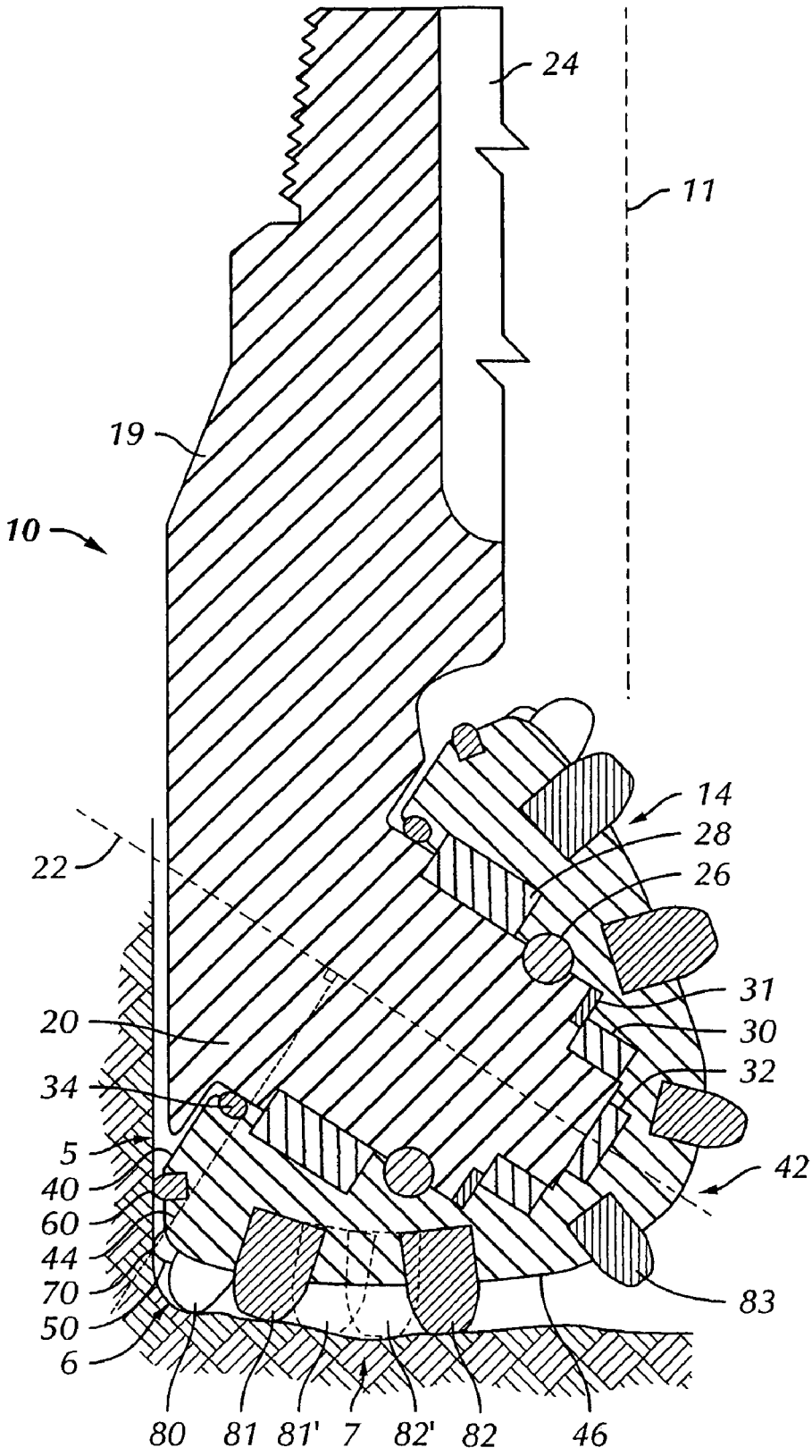
FIG. 2 is a partial section view taken through one leg and one rolling cone cutter of the bit shown in FIG. 1.

Referring now to FIG. 2, in conjunction with FIG. 1, each cutter 14–16 is rotatably mounted on a pin or journal 20, with an axis of rotation 22 orientated generally downwardly and inwardly toward the center of the bit. Drilling fluid is pumped from the surface through fluid passage 24 where it is circulated through an internal passageway (not shown) to nozzles 18 (FIG. 1). Each cutter 14–16 is typically secured on pin 20 by ball bearings 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit. In such instances, the cones 14, 15, 16 would be mounted on pins 20 without roller bearings 28, 30. In both roller bearing and friction bearing bits, lubricant may be supplied from reservoir 17 to the bearings by apparatus that is omitted from the figures for clarity. The lubricant is sealed and drilling fluid excluded by means of an annular seal 34. The borehole created by bit 10 includes sidewall 5, corner portion 6 and bottom 7, best shown in FIG. 2. Referring still to FIGS. 1 and 2, each cutter 14–16 includes a backface 40 and nose portion 42 spaced apart from backface 40. Cutters 14–16 further include a frustoconical surface 44 that is adapted to retain cutter elements that scrape or ream the sidewalls of the borehole as cutters 14–16 rotate about the borehole bottom. Frustoconical surface 44 will be referred to herein as the "heel" surface of cutters 14–16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Conical surface 46 typically includes a plurality of generally frustoconical segments 48 generally referred to as "lands" which are employed to support and secure the cutter elements as described in more is detail below. Grooves 49 are formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as a radius, to various degrees such that shoulder 50 will define a contoured zone of convergence between frustoconical heel surface 44 and the conical surface 46.

In the embodiment of the invention shown in FIGS. 1 and 2, each cutter 14–16 includes a plurality of wear resistant inserts 60, 70, 80 that include generally cylindrical base portions that are secured by interference fit into mating sockets drilled into the lands of the cone cutter, and cutting portions that are connected to the base portions and that extend beyond the surface of the cone cutter. The cutting portion includes a cutting surface that extends from cone surfaces 44, 46 for cutting formation material. The present invention will be understood with reference to one such cutter 14, cones 15, 16 being similarly, although not necessarily identically, configured.

Figure 3:
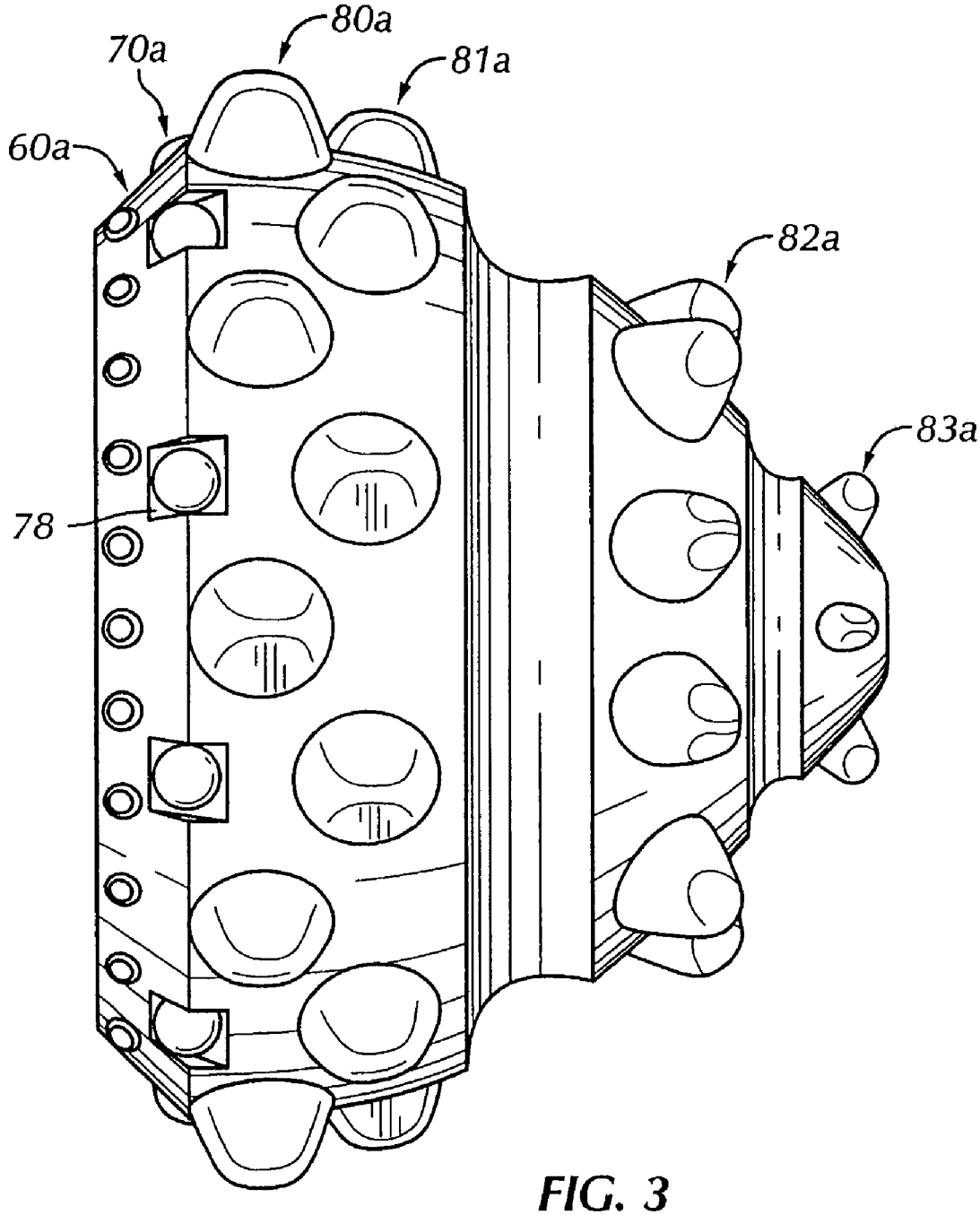
FIG. 3 is a perspective view of one cutter of the bit of FIG. 1.

Cone cutter 14 includes a plurality of heel row inserts 60 that are secured in a circumferential row 60*a* in the frustoconical heel surface 44. Cutter 14 further includes a circumferential row 70*a* of gage inserts 70 secured to cutter 14 in locations along or near the circumferential shoulder 50. Cutter 14 further includes a plurality of inner row inserts 80, 81, 82, 83 secured to cone surface 46 and arranged in spaced-apart inner rows 80*a*, 81*a*, 82*a*, 83*a*, respectively. Relieved areas or lands 78 (best shown in FIG. 3) are formed about gage cutter elements 70 to assist in mounting inserts 70. As understood by those skilled in this art, heel inserts 60 generally function to scrape or ream the borehole sidewall 5 to maintain the borehole at full gage and prevent erosion and abrasion of heel surface 44. Cutter elements 81, 82 and 83 of inner rows 81*a*, 82*a*, 83*a* are employed primarily to gouge and remove formation material from the borehole bottom 7. Inner rows 80*a*, 81*a*, 82*a*, 83*a* are arranged and spaced on cutter 14 so as not to interfere with the inner rows on each of the other cone cutters 15, 16.

Figure 9:
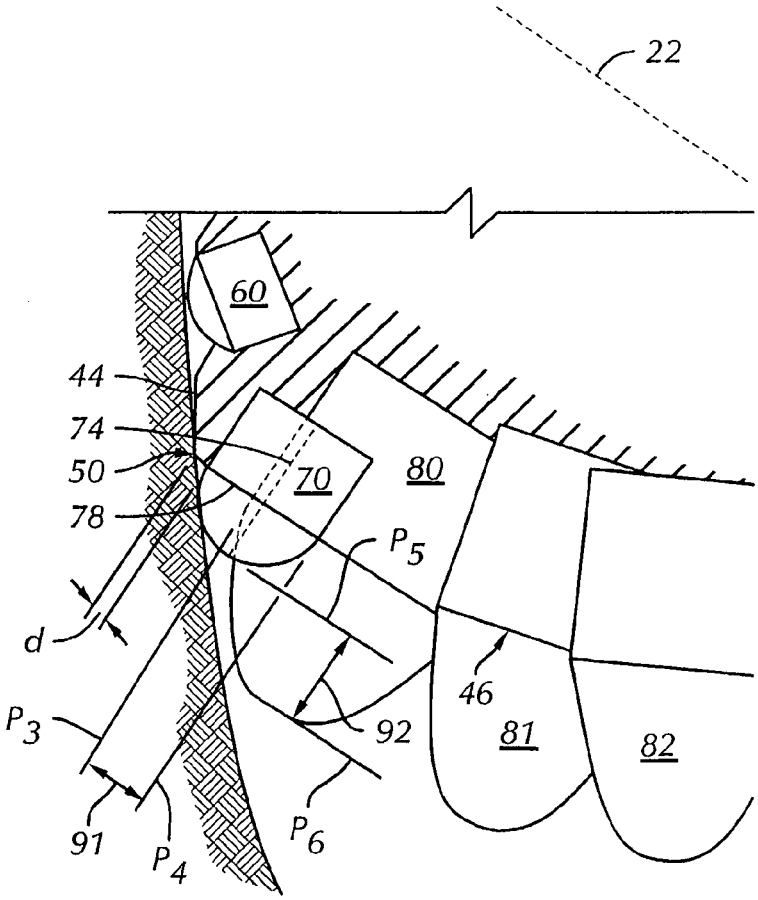
FIG. 9 is a cross sectional view of a portion of rolling cone cutter showing another alternative embodiment of the invention.

As shown in FIGS. 1–4, the preferred placement of gage cutter elements 70 is a position along circumferential shoulder 50. This mounting position enhances bit 10's ability to divide corner cutter duty among inserts 70 and 80 as described more fully below. This position also enhances the drilling fluid's ability to clean the inserts and to wash the formation chips and cuttings past heel surface 44 towards the top of the borehole. Despite the advantage provided by placing gage cutter elements 70 along shoulder 50, many of the substantial benefits of the present invention may be achieved where gage inserts 70 are positioned adjacent to circumferential shoulder 50, on either conical surface 46 (FIG. 9) or on heel surface 44 (FIG. 5). For bits having gage cutter elements 70 positioned adjacent to shoulder 50, the precise distance of gage cutter elements 70 to shoulder 50 will generally vary with bit size: the larger the bit, the larger the distance can be between shoulder 50 and cutter element 70 while still providing the desired division of corner cutting duty between cutter elements 70 and 80. The benefits of the invention diminish, however, if gage cutter elements are positioned too far from shoulder 50, particularly when placed on heel surface 44. The distance between shoulder 50 to cutter elements 70 is measured from shoulder 50 to the nearest edge of the gage cutter element 70, the distance represented by "d" as shown in FIGS. 9 & 5. Thus, as used herein to describe the mounting position of cutter elements 70 relative to shoulder 50, the term "adjacent" shall mean on shoulder 50 or on either surface 46 or 44 within the ranges set forth in the following table:

TABLE 1

| Bit Diameter "BD" (inches) | Distance from Shoulder 50 Along Surface 46 (inches) | Distance from Shoulder 50 Along Heel Surface 44 (inches) |
|---|---|---|
| BD # 7 | .120 | .060 |
| 7 < BD # 10 | .180 | .090 |
| 10 < BD # 15 | .250 | .130 |
| BD > 15 | .300 | .150 |

The spacing between heel inserts 60, gage inserts 70 and inner row inserts 80–83, is best shown in FIG. 2 which also depicts the borehole formed by bit 10 as it progresses through the formation material. FIG. 2 also shows the cutting profiles of inserts 60, 70, 80 as viewed in rotated profile, that is with the cutting profiles of the cutter elements shown rotated into a single plane. The rotated cutting profiles and cutting position of inner row inserts 81, 82, inserts that are mounted and positioned on cones 15, 16 to cut formation material between inserts 81, 82 of cone cutter 14, are also shown in phantom. Gage inserts 70 are positioned such that their cutting surfaces cut to full gage diameter, while the cutting surfaces of off-gage inserts 80 are strategically positioned off-gage. Due to this positioning of the cutting surfaces of gage inserts 70 and first inner row inserts 80 in relative close proximity, it can be seen that gage inserts 70 cut primarily against sidewall 5 while inserts 80 cut primarily against the borehole bottom 7.

Figure 4:
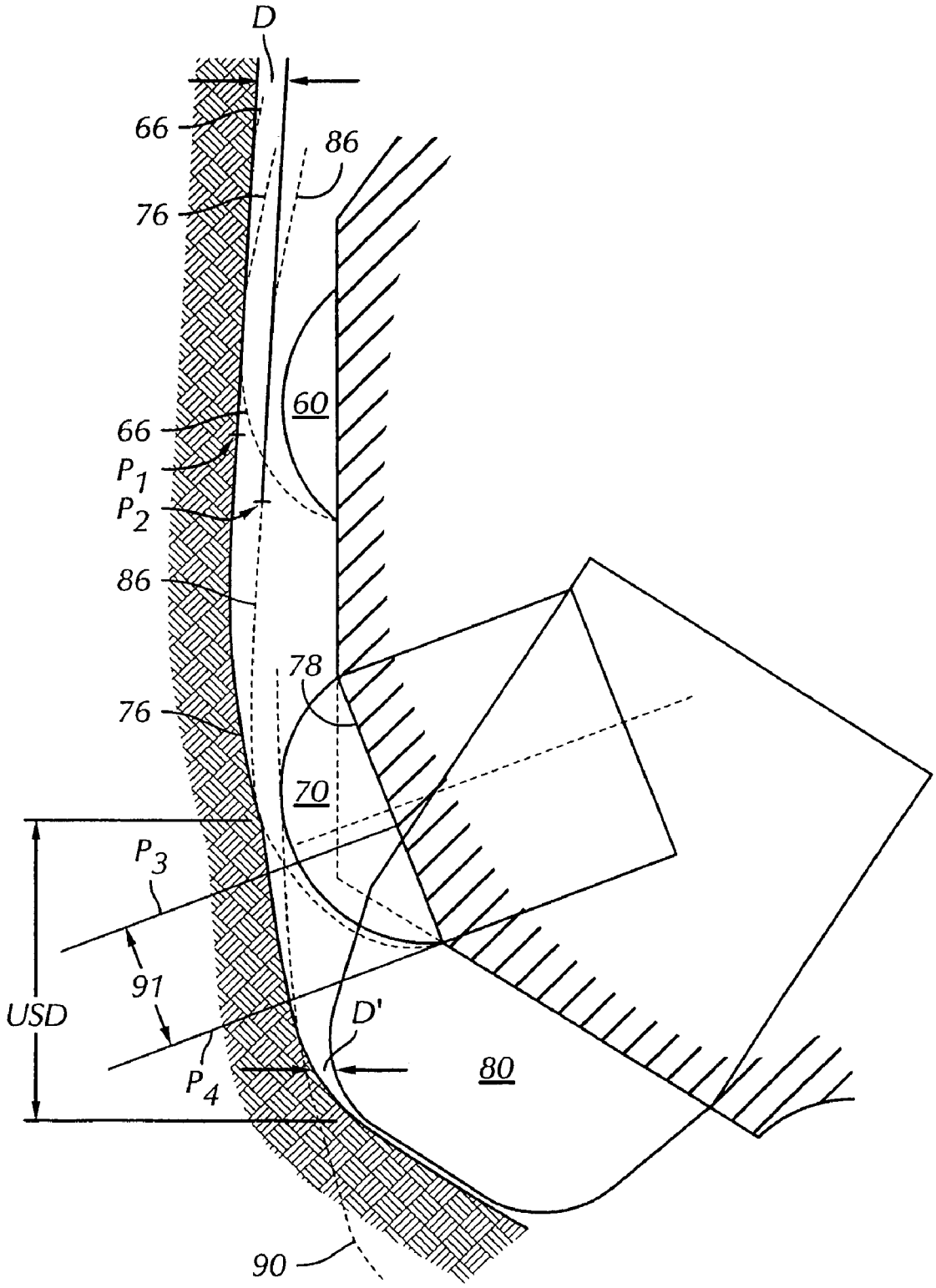
FIG. 4 is a enlarged view, partially in cross-section, of a portion of the cutting structure of the cutter shown in FIGS. 2 and 3, and showing the cutting paths traced by certain of the cutter elements mounted on that cutter.
Figure 5:
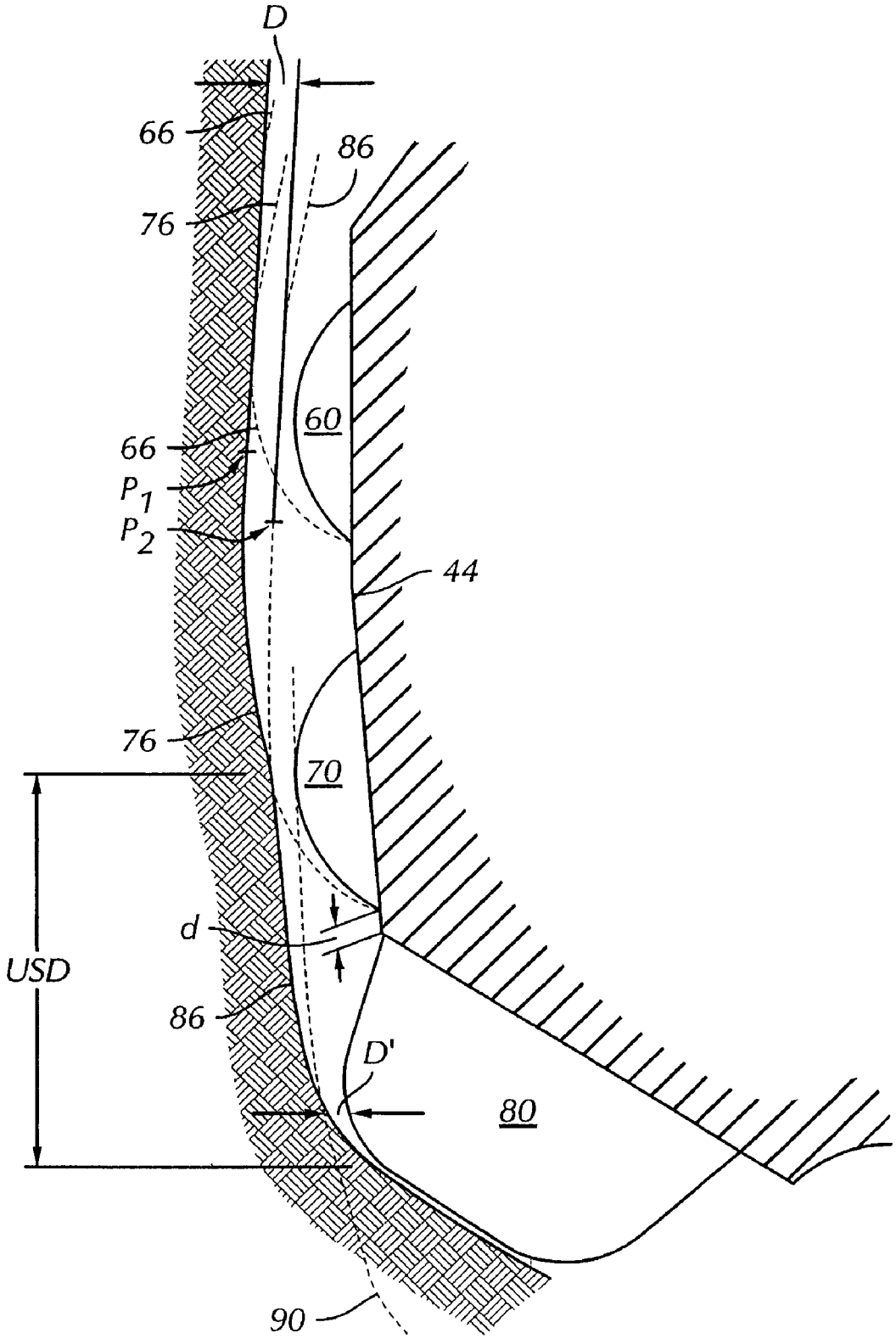
FIG. 5 is a view similar to FIG. 4 showing an alternative embodiment of the invention.

The cutting paths taken by heel row inserts 60, gage row inserts 70 and the first inner row inserts 80 are shown in more detail in FIG. 4. Referring to FIGS. 2 and 4, each cutter element 60, 70, 80 will cut formation material as cone 14 is rotated about its axis 22. As bit 10 descends further into the formation material, the cutting paths traced by cutters 60, 70, 80 may be depicted as a series of curves. In particular: heel row inserts 60 will cut along curve 66; gage row inserts 70 will cut along curve 76; and cutter elements 80 of first inner row 80*a* will cut along curve 86. As shown in FIG. 4, curve 76 traced by gage insert 70 extends further from the bit axis 11 (FIG. 2) than curve 86 traced by first inner row cutter element 80. The most radially distant point on curve 76 as measured from bit axis 11 is identified as $P_1$. Likewise, the most radially distant point on curve 86 is denoted by $P_2$. As curves 76, 86 show, as bit 10 progresses through the formation material to form the borehole, the first inner row cutter elements 80 do not extend radially as far into the formation as gage inserts 70. Thus, instead of extending to full gage, inserts 80 of first inner row 80*a* extend to a position that is "off-gage" by a predetermined distance D, D being the difference in radial distance between points $P_1$ and $P_2$ as measured from bit axis 11.

As understood by those skilled in the art of designing bits, a "gage curve" is commonly employed as a design tool to ensure that a bit made in accordance to a particular design will cut the specified hole diameter. The gage curve is a complex mathematical formulation which, based upon the parameters of bit diameter, journal angle, and journal offset, takes all the points that will cut the specified hole size, as located in three dimensional space, and projects these points into a two dimensional plane which contains the journal centerline and is parallel to the bit axis. The use of the gage curve greatly simplifies the bit design process as it allows the gage cutting elements to be accurately located in two dimensional space which is easier to visualize. The gage curve, however, should not be confused with the cutting path of any individual cutting element as described previously.

A portion of gage curve 90 of bit 10 is depicted in FIG. 4. As shown, the cutting surface of off-gage cutter 80 is spaced radially inward from gage curve 90 by distance D', D' being the shortest distance between gage curve 90 and the cutting surface of off-gage cutter element 80. Given the relationship between cutting paths 76, 86 described above, in which the outer most point $P_1$, $P_2$ are separated by a radial distance D, D' will be equal to D. Accordingly, the first inner row of cutter elements 80 may be described as "off-gage," both with respect to the gage curve 90 and with respect to the cutting path 76 of gage cutter elements 70.

As known to those skilled in the art, the American Petroleum Institute (API) sets standard tolerances for bit diameters, tolerances that vary depending on the size of the bit. The term "off gage" as used herein to describe inner row cutter elements 80 refers to the difference in distance that cutter elements 70 and 80 radially extend into the formation (as described above) and not to whether or not cutter elements 80 extend far enough to meet an API definition for being on gage. That is, for a given size bit made in accordance with the present invention, cutter elements 80 of a first inner row 80*a* may be "off gage" with respect to gage cutter elements 70, but may still extend far enough into the formation such that cutter elements 80 of inner row 80*a* would fall within the API tolerances for being on gage for that given bit size. Nevertheless, cutter elements 80 would be "off gage" as that term is used herein because of their relationship to the cutting path taken by gage inserts 70. In more preferred embodiments of the invention, however, cutter elements 80 that are "off gage" (as herein defined) will also fall outside the API tolerances for the given bit diameter.

Referring again to FIGS. 2 and 4, it is shown that cutter elements 70 and 80 cooperatively operate to cut the corner 6 of the borehole, while inner row inserts 81, 82, 83 attack the borehole bottom. Meanwhile, heel row inserts 60 scrape or ream the sidewalls of the borehole, but perform no corner cutting duty because of the relatively large distance that heel row inserts 60 are separated from gage row inserts 70. Cutter elements 70 and 80 may be referred to as primary cutting structures in that they work in unison or concert to simultaneously cut the borehole corner, cutter elements 70 and 80 each engaging the formation material and performing their intended cutting function immediately upon the initiation of drilling by bit 10. Cutter elements 70, 80 are thus to be distinguished from what are sometimes referred to as "secondary" cutting structures which engage formation material only after other cutter elements have become worn.

As previously mentioned, gage row cutter elements 70 may be positioned on heel surface 44 according to the invention, such an arrangement being shown in FIG. 5 where the cutting paths traced by cutter elements 60, 70, 80 are depicted as previously described with reference to FIG. 4. Like the arrangement shown in FIG. 4, the cutter elements 80 extend to a position that is off-gage by a distance D, and the borehole corner cutting duty is divided among the gage cutter elements 70 and inner row cutter elements 80. Although in this embodiment gage row cutter elements 70 are located on the heel surface, heel row inserts 60 are still too far away to assist in the corner cutting duty.

Figure 6:
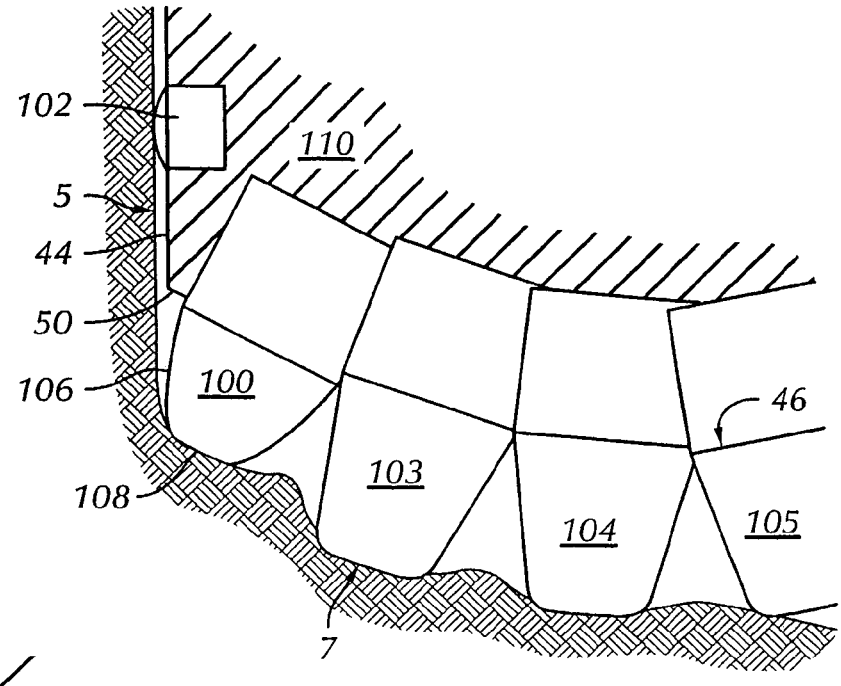
FIG. 6 (Prior Art)
FIG. 6 is a partial cross sectional view of a set of prior art rolling cone cutters (shown in rotated profile) and the cutter elements attached thereto.
Figure 7:
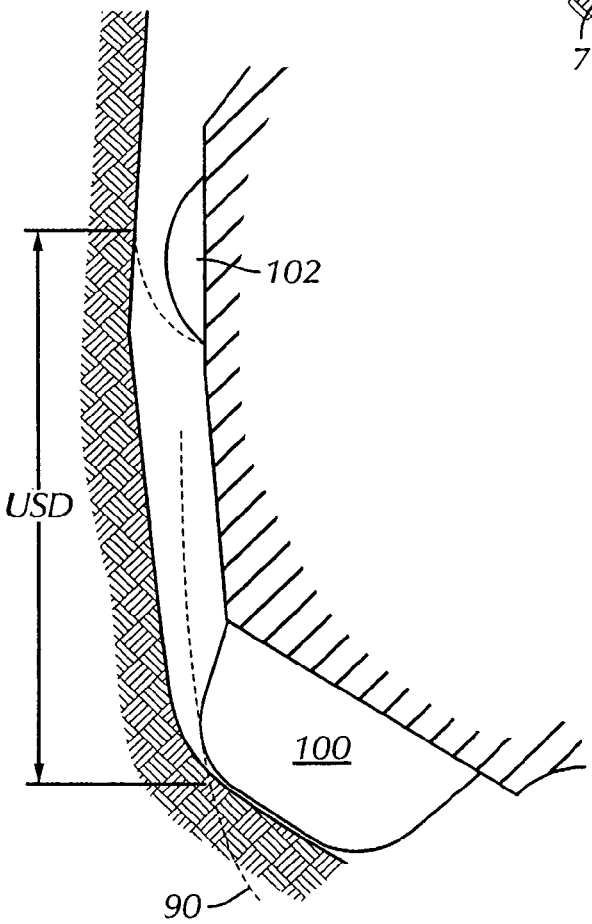
FIG. 7 (Prior Art)
FIG. 7 is an enlarged cross sectional view of a portion of the cutting structure of the prior art cutter shown in FIG. 6 and showing the cutting paths traced by certain of the cutter elements.

Referring to FIGS. 6 and 7, a typical prior art bit 110 is shown to have gage row inserts 100, heel row inserts 102 and inner row inserts 103, 104, 105. By contrast to the present invention, such conventional bits have typically employed cone cutters having a single row of cutter elements, positioned on gage, to cut the borehole corner. Gage inserts 100, as well as inner row inserts 103–105 are generally mounted on the conical bottom surface 46, while heel row inserts 102 are mounted on heel surface 44. In this arrangement, the gage row inserts 100 are required to cut the borehole corner without any significant assistance from any other cutter elements as best shown in FIG. 7. This is because the first inner row inserts 103 are mounted a substantial distance from gage inserts 100 and thus are too far away to be able to assist in cutting the borehole corner. Likewise, heel inserts 102 are too distant from gage cutter 100 to assist in cutting the borehole corner. Accordingly, gage inserts 100 traditionally have had to cut both the borehole sidewall 5 along cutting surface 106, as well as cut the borehole bottom 7 along the cutting surface shown generally at 108. Because gage inserts 100 have typically been required to perform both cutting functions, a compromise in the toughness, wear resistance, shape and other properties of gage inserts 100 has been required.

The failure mode of cutter elements usually manifests itself as either breakage, wear, or mechanical or thermal fatigue. Wear and thermal fatigue are typically results of abrasion as the elements act against the formation material. Breakage, including chipping of the cutter element, typically results from impact loads, although thermal and mechanical fatigue of the cutter element can also initiate breakage.

Referring still to FIG. 6, breakage of prior art gage inserts 100 was not uncommon because of the compromise in toughness that had to be made in order for inserts 100 to also withstand the sidewall cutting they were required to perform. Likewise, prior art gage inserts 100 were sometimes subject to rapid wear and thermal fatigue due to the compromise in wear resistance that was made in order to allow the gage inserts 100 to simultaneously withstand the impact loading typically present in bottom hole cutting.

Referring again to FIGS. 1–4, it has been determined that positioning the first inner row cutter elements 80 much closer to gage than taught by the prior art, but at the same time, maintaining a minimum distance from gage to cutter element 80, substantial improvements may be achieved in ROP, bit durability, or both. To achieve these results, it is important that the first inner row of cutter elements 80 be positioned close enough to gage cutter elements 70 such that the corner cutting duty is divided to a substantial degree between gage inserts 70 and inner row inserts 80. The distance D that inner row inserts 80 should be placed off-gage so as to allow the advantages of this division to occur is dependent upon the bit offset, the cutter element placement and other factors, but may also be expressed in terms of bit diameter as follows:

TABLE 2

| Bit Diameter "BD" (inches) | Acceptable Range for Distance D (inches) | Most Preferred Range for Distance D (inches) | Most Preferred Range for Distance D (inches) |
|---|---|---|---|
| BD # 7 | .015–.100 | .020–.080 | .020–.060 |
| 7 < BD # 10 | .020–.150 | .020–.120 | .030–.090 |
| 10 < BD # 15 | .025–.200 | .035–.160 | .045–.120 |
| BD > 15 | .030–.250 | .050–.200 | .060–.150 |

If cutter elements 80 of the first inner row 80*a* are positioned too far from gage, then gage row 70 will be required to perform more bottom hole cutting than would be preferred, subjecting it to more impact loading than if it were protected by a closely-positioned but off-gage cutter element 80. Similarly, if inner row cutter element 80 is positioned too close to the gage curve, then it would be subjected to loading similar to that experienced by gage inserts 70, and would experience more side hole cutting and thus more abrasion and wear than would be otherwise preferred. Accordingly, to achieve the appropriate division of cutting load, a division that will permit inserts 70 and 80 to be optimized in terms of shape, orientation, extension and materials to best withstand particular loads and penetrate particular formations, the distance that cutter element 80 is positioned off-gage is important.

Referring again to FIG. 6, conventional bits having a comparatively large distance between gage inserts 100 and first inner row inserts 103 typically have required that the cutter include a relatively large number of gage inserts in order to maintain gage and withstand the abrasion and sidewall forces imposed on the bit. It is known that increased ROP in many formations is achieved by having relatively fewer cutter elements in a given bottom hole cutting row such that the force applied by the bit to the formation material is more concentrated than if the same force were to be divided among a larger number of cutter elements. Thus, the prior art bit was again a compromise because of the requirement that a substantial number of gage inserts 100 be maintained on the bit in an effort to hold gage.

By contrast, and according to the present invention, because the sidewall and bottom hole cutting functions have been divided between gage inserts 70 and inner row inserts 80, a more aggressive cutting structure may be employed by having a comparatively fewer number of first inner row cutter elements 80 as compared to the number of gage row inserts 100 of the prior art bit shown in FIG. 6. In other words, because in the present invention gage inserts 70 cut the sidewall of the borehole and are positioned and configured to maintain a full gage borehole, first inner row elements 80, that do not have to function to cut sidewall or maintain gage, may be fewer in number and may be further spaced so as to better concentrate the forces applied to the formation. Concentrating such forces tends to increase ROP in certain formations. Also, providing fewer cutter elements 80 on the first inner row 80*a* increases the pitch between the cutter elements and the chordal penetration, chordal penetration being the maximum penetration of an insert into the formation before adjacent inserts in the same row contact the hole bottom. Increasing the chordal penetration allows the cutter elements to penetrate deeper into the formation, thus again tending to improve ROP. Increasing the pitch between inner row inserts 80 has the additional advantages that it provides greater space between the inserts which results in improved cleaning of the inserts and enhances cutting removal from hole bottom by the drilling fluid.

The present invention may also be employed to increase durability of bit 10 given that inner row cutter elements 80 are positioned off-gage where they are not subjected to the load from the sidewall that is instead assumed by the gage row inserts. Accordingly, inner row inserts 80 are not as susceptible to wear and thermal fatigue as they would be if positioned on gage. Further, compared to conventional gage row inserts 100 in bits such as that shown in FIG. 6, inner row inserts 80 of the present invention are called upon to do substantially less work in cutting the borehole sidewall. The work performed by a cutter element is proportional to the force applied by the cutter element to the formation multiplied by the distance that the cutter element travels while in contact with the formation, such distance generally referred to as the cutter element's "strike distance." In the present invention in which gage inserts 70 are positioned on gage and inner row inserts 80 are off-gage a predetermined distance, the effective or unassisted strike distance of inserts 80 is lessened due to the fact that cutter elements 70 will assist in cutting the borehole wall and thus will lessen the distance that insert 80 must cut unassisted. This results in less wear, thermal fatigue and breakage for inserts 80 relative to that experienced by conventional gage inserts 100 under the same conditions. The distance referred to as the "unassisted strike distance" is identified in FIGS. 4 and 5 by the reference "USD." As will be understood by those skilled in the art, the further that inner row cutter elements 80 are off-gage, the shorter the unassisted strike distance is for cutter elements 80. In other words, by increasing the off-gage distance D, cutter elements 80 are required to do less work against the borehole sidewall, such work instead being performed by gage row inserts 70. This can be confirmed by comparing the relatively long unassisted strike distance USD for gage inserts 100 in the prior art bit of FIG. 7 to the unassisted strike distance USD of the present invention (FIGS. 4 and 5 for example).

Figure 8:
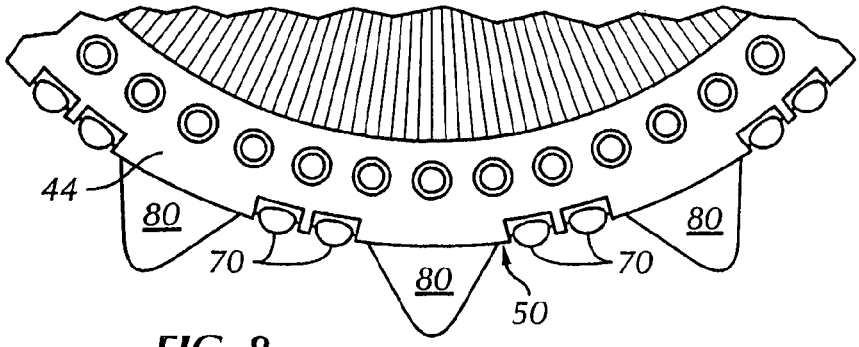
FIG. 8 is a partial elevational view of a rolling cone cutter showing still another alternative embodiment of the invention.

Referring again to FIG. 1, it is generally preferred that gage row cutter elements 70 be circumferentially positioned at locations between each of the inner row elements 80. With first inner row cutter elements 80 moved off-gage where they are not responsible for substantial sidewall cutting, the pitch between inserts 80 may be increased as previously described in order to increase ROP. Additionally, with increased spacing between adjacent cutter elements 80 in row 80*a*, two or more gage inserts 70 may be disposed between adjacent inserts 80 as shown in FIG. 8. This configuration further enhances the durability of bit 10 by providing a greater number of gage cutter elements 70 adjacent to circumferential shoulder 50.

An additional advantage of dividing the borehole cutting function between gage inserts 70 and off-gage inserts 80 is the fact that it allows much smaller diameter cutter elements to be placed on gage than conventionally employed for a given size bit. With a smaller diameter, a greater number of inserts 70 may be placed around the cutter 14 to maintain gage, and because gage inserts 70 are not required to perform substantial bottom hole cutting, the increase in number of gage inserts 70 will not diminish or hinder ROP, but will only enhance bit 10's ability to maintain full gage. At the same time, the invention allows relatively large diameter or large extension inserts to be employed as off-gage inserts 80 as is desirable for gouging and breaking up formation on the hole bottom. Consequently, in preferred embodiments of the invention, the ratio of the diameter of gage inserts 70 to the diameter of first inner row inserts 80 is preferably not greater than 0.75. Presently, a still more preferred ratio of these diameters is within the range of 0.5 to 0.725.

Also, given the relatively small diameter of gage inserts 70 (as compared both to inner row inserts 80 and to conventional gage inserts 100 as shown in FIG. 6), the invention preferably positions gage inserts 70 and inner row inserts 80 such that the ratio of distance D that inserts 80 are off-gage to the diameter of gage insert 70 should be less than 0.3, and even more preferably less than 0.2. It is desirable in certain applications that this ratio be within the range of 0.05 to 0.15.

Positioning inserts 70 and 80 in the manner previously described means that the cutting profiles of the inserts 70, 80, in many embodiments, will partially overlap each other when viewed in rotated profile as is best shown in FIGS. 4 or 9. Referring to FIG. 9, the extent of overlap is a function of the diameters of the inserts 70, 80, the off-gage distance D of insert 80, and the inserts' orientation, shape and extension from cutter 14. As used herein, the distance of overlap 91 is defined as the distance between parallel planes $P_3$ and $P_4$ shown in FIG. 9. Plane $P_3$ is a plane that is parallel to the axis 74 of gage insert 70 and that passes through the point of intersection between the cylindrical base portion of the inner row insert 80 and the land 78 of gage insert 70. $P_4$ is a plane that is parallel to $P_3$ and that coincides with the edge of the cylindrical base portion of gage row insert 70 that is closest to bit axis as shown in FIG. 9. This definition also applies to the embodiment shown in FIG. 4.

The greater the overlap between cutting profiles of cutter elements 70, 80 means that inserts 70, 80 will share more of the corner cutting duties, while less overlap means that the gage inserts 70 will perform more sidewall cutting duty, while off-gage inserts 80 will perform less sidewall cutting duty. Depending on the size and type of bit and the type formation, the ratio of the distance of overlap to the diameter of the gage inserts 70 is preferably greater than 0.40.

As those skilled in the art understand, the International Association of Drilling Contractors (IADC) has established a classification system for identifying bits that are suited for particular formations. According to this system, each bit presently falls within a particular three digit IADC classification, the first two digits of the classification representing, respectively, formation "series" and formation "type." A "series" designation of the numbers 1 through 3 designates steel tooth bits, while a "series" designation of 4 through 8 refers to tungsten carbide insert bits. According to the present classification system, each series 4 through 8 is further divided into four "types," designated as 1 through 4. TCI bits are currently being designed for use in significantly softer formations than when the current IADC classification system was established. Thus, as used herein, an IADC classification range of between "41–62" should be understood to mean bits having an IADC classification within series 4 (types 1–4), series 5 (types 1–4) or series 6 (type 1 or type 2) or within any later adopted IADC classification that describes TCI bits that are intended for use in formations softer than those for which bits of current series 6 (type 1 or 2) are intended.

In the present invention, because the cutting functions of cutter elements 70 and 80 have been substantially separated, it is generally desirable that cutter elements 80 extend further from cone 14 than elements 70 (relative to cone axis 22). This is especially true in bits designated to drill in soft through some medium hard formations, such as in steel tooth bits or in TCI insert bits having the IADC formation classifications of between 41–62. This difference in extensions may be described as a step distance 92, the "step distance" being the distance between planes $P_5$ and $P_6$ measured perpendicularly to cone axis 22 as shown in FIG. 9. Plane $P_5$ is a plane that is parallel to cone axis 22 and that intersects the radially outermost point on the cutting surface of cutter element 70. Plane $P_6$ is a plane that is parallel to cone axis 22 and that intersects the radially outermost point on the cutting surface of cutter element 80. According to certain preferred embodiments of the invention, the ratio of the step distance to the extension of gage row cutter elements 70 above cone 14 should be not less than 0.8 for steel tooth bits and for TCI formation insert bits having IADC classification range of between 41–62. More preferably, this ratio should be greater than 1.0.

As mentioned previously, it is preferred that first inner row cutter elements 80 be mounted off-gage within the ranges specified in Table 2. In a preferred embodiment of the invention, the off-gage distance D will be selected to be the same for all the cone cutters on the bit. This is a departure from prior art multi-cone bits which generally have required that the off-gage distance of the first inner row of cutter elements be different for some of the cone cutters on the bit. In the present invention, where D is the same for all the cone cutters on the bit, the number of gage cutter elements 70 may be the same for each cone cutter and, simultaneously, all the cone cutters may have the same number of off-gage cutter elements 80. In other embodiments of the invention, as shown in FIG. 1, there are advantages to varying the distance that inner row cutter elements 80 are off-gage between the various cones 14–16. For example, in one embodiment of the invention, cutter elements 80 on cutter 14 are disposed 0.040 inches off-gage, while cutter elements 80 on cones 15 and 16 are positioned 0.060 inches off-gage.

Varying among the cone cutters 14–16 the distance D that first inner row cutter elements 80 are off-gage allows a balancing of durability and wear characteristics for all the cones on the bit. More specifically, it is typically desirable to build a rolling cone bit in which the number of gage row and inner row inserts vary from cone to cone. In such instances, the cone having the fewest cutter elements cutting the sidewall or borehole corner will experience higher wear or impact loading compared to the other rolling cones which include a larger number of cutter elements. If the off-gage distance D was constant for all the cones on the bit, there would be no means to prevent the cutter elements on the cone having the fewest cutter elements from wearing or breaking prematurely relative to those on the other cones. On the other hand, if the first inner row of off-gage cutter elements 80 on the cone having the fewest cutter elements was experiencing premature wear or breakage from sidewall impact relative to the other cones on the bit, improved overall bit durability could be achieved by increasing the off-gage distance D of cutter elements 80 on that cone so as to lessen the sidewall cutting performed by that cone's elements 80. Conversely, if the gage row inserts 70 on the cone having the fewest cutter elements were to experience excessive wear or impact damage, improved overall bit durability could be obtained by reducing the off-gage distance D of off-gage cutter elements 80 on that cone so as to increase the sidewall cutting duty performed by the cone's off-gage cutter elements 80.

By dividing the borehole corner cutting duty between gage cutter elements 70 and first inner row cutter elements 80, further and significant additional enhancements in bit durability and ROP are made possible. Specifically, the materials that are used to form elements 70, 80 can be optimized to correspond to the demands of the particular application for which each element is intended. In addition, the elements can be selectively and variously coated with super abrasives, including polycrystalline diamond ("PCD") or cubic boron nitride ("PCBN") to further optimize their performance. These enhancements allow cutter elements 70, 80 to withstand particular loads and penetrate particular formations better than would be possible if the materials were not optimized as contemplated by this invention. Further material optimization is in turn made possible by the division of corner cutting duty.

The gage cutter element of a conventional bit is subjected to high wear loads from the contact with borehole wall, as well as high stresses due to bending and impact loads from contact with the borehole bottom. The high wear load can cause thermal fatigue, which initiates surface cracks on the cutter element. These cracks are further propagated by a mechanical fatigue mechanism that is caused by the cyclical bending stresses and/or impact loads applied to the cutter element. These result in chipping and, more severely, in catastrophic cutter element breakage and failure.

The gage cutter elements 70 of the present invention are subjected to high wear loads, but are subjected to relatively low stress and impact loads, as their primary function consists of scraping or reaming the borehole wall. Even if thermal fatigue should occur, the potential of mechanically propagating these cracks and causing failure of a gage cutter element 70 is much lower compared to conventional bit designs. Therefore, the present gage cutter element exhibits greater ability to retain its original geometry, thus improving the ROP potential and durability of the bit.

As explained in more detail below, the invention thus includes using a different grade of hard metal, such as cemented tungsten carbide, for gage cutter elements 70 than that used for first inner row cutter elements 80. Additionally, the use of super abrasive coatings that differ in abrasive resistance and toughness, alone or in combination with hard metals, yields improvements in bit durability and penetration rates. Specific grades of cemented tungsten carbide and PCD or PCBN coatings can be selected depending primarily upon the characteristics of the formation and operational drilling practices to be encountered by bit 10.

Cemented tungsten carbide inserts formed of particular formulations of tungsten carbide and a cobalt binder (WC—Co) are successfully used in rock drilling and earth cutting applications. This material's toughness and high wear resistance are the two properties that make it ideally suited for the successful application as a cutting structure material. Wear resistance can be determined by several ASTM standard test methods. It has been found that the ASTM B611 test correlates well with field performance in terms of relative insert wear life. It has further been found that the ASTM B771 test, which measures the fracture toughness (K1c) of cemented tungsten carbide material, correlates well with the insert breakage resistance in the field.

It is commonly known in the cemented tungsten carbide industry that the precise WC—Co composition can be varied to achieve a desired hardness and toughness. Usually, a carbide material with higher hardness indicates higher resistance to wear and also lower toughness or lower resistance to fracture. A carbide with higher fracture toughness normally has lower relative hardness and therefore lower resistance to wear. Therefore there is a trade-off in the material properties and grade selection. The most important consideration for bit design is to select the best grade for its application based on the formation material that is expected to be encountered and the operational drilling practices to be employed.

As understood by those skilled in the art, the wear resistance of a particular cemented tungsten carbide cobalt binder formulation (WC—Co) is dependent upon the grain size of the tungsten carbide, as well as the percent, by weight, of cobalt that is mixed with the tungsten carbide. Although cobalt is the preferred binder metal, other binder metals, such as nickel and iron can be used advantageously. In general, for a particular weight percent of cobalt, the smaller the grain size of the tungsten carbide, the more wear resistant the material will be. Likewise, for a given grain size, the lower the weight percent of cobalt, the more wear resistant the material will be. Wear resistance is not the only design criteria for cutter elements 70, 80, however. Another trait critical to the usefulness of a cutter element is its fracture toughness, or ability to withstand impact loading. In contrast to wear resistance, the fracture toughness of the material is increased with larger grain size tungsten carbide and greater percent weight of cobalt. Thus, fracture toughness and wear resistance tend to be inversely related, as grain size changes that increase the wear resistance of a specimen will decrease its fracture toughness, and vice versa.

Due to irregular grain shapes, grain size variations and grain size distribution within a single grade of cemented tungsten carbide, the average grain size of a particular specimen can be subject to interpretation. Because for a fixed weight percent of cobalt the hardness of a specimen is inversely related to grain size, the specimen can be adequately defined in terms of its hardness and weight percent cobalt, without reference to its grain size. Therefore, in order to avoid potential confusion arising out of generally less precise measurements of grain size, specimens will hereinafter be defined in terms of hardness (measured in hardness Rockwell A (HRa)) and weight percent cobalt.

As used herein to compare or claim physical characteristics (such as wear resistance or hardness) of different cutter element materials, the term "differs" means that the value or magnitude of the characteristic being compared varies by an amount that is greater than that resulting from accepted variances or tolerances normally associated with the manufacturing processes that are used to formulate the raw materials and to process and form those materials into a cutter element. Thus, materials selected so as to have the same nominal hardness or the same nominal wear resistance will not "differ," as that term has thus been defined, even though various samples of the material, if measured, would vary about the nominal value by a small amount. By contrast, each of the grades of cemented tungsten carbide and PCD identified in the Tables herein "differs" from each of the others in terms of hardness, wear resistance and fracture toughness.

There are today a number of commercially available cemented tungsten carbide grades that have differing, but in some cases overlapping, degrees of hardness, wear resistance, compressive strength and fracture toughness. One of the hardest and most wear resistant of these grades presently used in softer formation petroleum bits is a finer grained tungsten carbide grade having a nominal hardness of 90–91 HRa and a cobalt content of 6% by weight. Although wear resistance is an important quality for use in cutter elements, this carbide grade unfortunately has relatively low toughness or ability to withstand impact loads as is required for cutting the borehole bottom. Consequently, and referring momentarily to FIG. 6, in many prior art petroleum bits, cutter elements formed of this tungsten carbide grade have been limited to use as heel row inserts 102. Inner rows 103–105 of petroleum bits intended for use in softer formations have conventionally been formed of coarser grained tungsten carbide grades having nominal hardnesses in the range of 85.8–86.4 HRa, with cobalt contents of 14–16 percent by weight because of this material's ability to withstand impact loading. This formulation was employed despite the fact that this material has a relatively low wear resistance and despite the fact that, even in bottom hole cutting, significant wear can be experienced by inner row cutter elements 103–105 of conventional bits in particular formations.

As will be recognized, the choice of materials for prior art gage inserts 100 (FIG. 6) was a compromise. Although gage inserts 100 experienced both significant side wall and bottom hole cutting duty, they could not be made as wear resistant as desirable for side wall cutting, nor as tough as desired for bottom hole cutting. Making the gage insert more wear resistant caused the insert to be less able to withstand the impact loading. Likewise, making the insert 100 tougher so as to enable it to withstand greater impact loading caused the insert to be less wear resistant. Because the choice of material for conventional gage inserts 100 was a compromise, the prior art softer formation petroleum bits typically employed a medium grained cemented tungsten carbide having nominal hardness around 88.1–88.8 HRa with cobalt contents of 10–11% by weight.

The following table reflects the wear resistance and other mechanical properties of various commercially-available cemented tungsten carbide compositions:

TABLE 3

Properties of Typical Cemented Tungsten Carbide Insert Grades Used in Oil/Gas Drilling

| Cobalt content [wt. %] | Nominal Hardness [HRa] | Nominal Fracture Toughness K1c per ASTM test B771 [ksi$\sqrt{in}$] | Nominal Wear Resistance per ASTM test B611 [1000 rev/cc] |
|---|---|---|---|
| 6 | 90.8 | 10.8 | 10.0 |
| 11 | 89.4 | 11.0 | 6.1 |
| 11 | 88.8 | 12.5 | 4.1 |
| 10 | 88.1 | 13.2 | 3.8 |
| 12 | 87.4 | 14.1 | 3.2 |
| 16 | 87.3 | 13.7 | 2.6 |
| 14 | 86.4 | 16.8 | 2.0 |
| 16 | 85.8 | 17.0 | 1.9 |

Referring again to FIGS. 1–4, according to the present invention, it is desirable to form gage cutter elements 70 from a very wear resistant carbide grade for most formations. Preferably gage cutter elements 70 should be formed from a finer grained tungsten carbide grade having a nominal hardness in the range of approximately 88.1–90.8 HRa, with a cobalt content in the range of about 6–11 percent by weight. Suitable tungsten carbide grades include those having the following compositions:

TABLE 4

Properties of Grades of Cemented Tungsten Carbide Presently Preferred for Gage Cutter Element 70 for Oil/Gas Drilling

| Cobalt content [wt. %] | Nominal Hardness [HRa] | Nominal Fracture Toughness K1c per ASTM test B771 [ksi % in] | Nominal Wear Resistance per ASTM test B611 [1000 rev/cc] |
|---|---|---|---|
| 6 | 90.8 | 10.8 | 10.0 |
| 11 | 89.4 | 11.0 | 6.1 |
| 11 | 88.8 | 12.5 | 4.1 |
| 10 | 88.1 | 13.2 | 3.8 |

The tungsten carbide grades are listed from top to bottom in Table 4 above in order of decreasing wear resistance, but increasing fracture toughness.

In general, a harder grade of tungsten carbide with a lower cobalt content is less prone to thermal fatigue. The division of cutting duties provided by the present invention allows use of a gage cutter element 70 that is a harder and more thermally stable than is possible in prior art bit designs, which in turn improves the durability and ROP potential of the bit.

In contrast, for first inner row of cutter elements 80, which must withstand the bending moments and impact loading inherent in bottom hole drilling, it is preferred that a tougher and more impact resistant material be used, such as the tungsten carbide grades shown in the following table:

TABLE 5

Properties of Grades of Cemented Tungsten Carbide Presently Preferred for Off- Gage Cutter Element 80 for Oil/Gas Drilling

| Cobalt content [wt. %] | Nominal Hardness [Hra] | Nominal Fracture Toughness K1c per ASTM test B771 [ksi√in] | Nominal Wear Resistance per ASTM test B611 [1000 rev/cc] |
|---|---|---|---|
| 11 | 88.8 | 12.5 | 4.1 |
| 10 | 88.1 | 13.2 | 3.8 |
| 12 | 87.4 | 14.1 | 3.2 |
| 16 | 87.3 | 13.7 | 2.6 |
| 14 | 86.4 | 16.8 | 2.0 |
| 16 | 85.8 | 17.0 | 1.9 |

With one exception, the tungsten carbide grades identified from top to bottom in Table 5 increase in fracture toughness and decrease in wear resistance (the grade having 12% cobalt and a nominal hardness of 87.4 HRa being tougher than the grade having 16% cobalt and a hardness of 87.3 HRa). Although an overlap exists in grades for gage and off-gage use, the off-gage cutter elements 80 will, in most all instances, be made of a tungsten carbide grade having a hardness that is less than that the gage cutter element 70. In most applications, cutter elements 80 will be of a material that is less wear resistant and more impact resistant. The relative difference in hardness between gage and off-gage cutter elements is dependent upon the application. For harder formation bit types, the relative difference is less, and conversely, the difference becomes larger for soft formation bits.

It will be understood that the present invention is not limited by the cemented tungsten carbide grades identified in Tables 3–5 above. Typically in mining applications, it is preferred to use harder grades, especially on inner rows. Also, the invention contemplates using harder, more wear resistant and/or tougher grades such as micrograin and nanograin tungsten carbide composites as they are technically developed.

According to one preferred embodiment of the invention, gage inserts 70 will be formed of a cemented tungsten carbide grade having a nominal hardness of 90.8 HRa and a cobalt content of 6% by weight and thus will have the wear resistance that previously was used in heel inserts 102 of the prior art (FIG. 6). At the same time, the closely spaced but off-gage inserts 80 will be formed of a tungsten carbide grade having a nominal hardness of 86.4 HRa and a cobalt content of 14% by weight, this grade having the impact resistance conventionally employed on inner rows 103–105 in prior art bits (FIG. 6). By optimizing the fracture toughness of inserts 80 for the particular formation to be drilled as contemplated by this invention, inserts 80 may have longer extensions or more aggressive cutting shapes, or both, so as to increase the ROP potential of the bit. Furthermore, by making first inner row cutter elements 80 from a tougher material than has been conventionally used for gage row cutter elements, the number of cutter elements 80 can be decreased and the pitch or distance between adjacent cutter elements 80 can be increased (relative to the distance between adjacent prior art gage inserts 100 of FIG. 6). This can lead to improvements in ROP, as described previously. The longest strike distance on the borehole wall for the gage cutter inserts 70 occurs in large diameter, soft formation bit types with large offset. For those bits, a hard and wear-resistant tungsten carbide grade for the gage inserts 70 is important, particularly in abrasive formations.

In addition, due to the increased gage durability, resulting from the above-described cutter element placement geometry and material optimization, the range of applications in which a bit of the present invention can be used is expanded. Since both ROP and bit durability are improved, it becomes economical to use the same bit type over a wider range of formations. A bit made in accordance to the present invention can be particularly designed to have sufficient strength/durability to enable it to drill harder or more abrasive sections of the borehole, and also to drill with competitive ROP in sections of the borehole where softer formations are encountered.

According to the present invention, substantial improvements in bit life and the ability of the bit to drill a full gage borehole are also afforded by employing cutter elements 70, 80 having coatings comprising differing grades of super abrasives. Such super abrasives may be, for example, PCD or PCBN coatings applied to the cutting surfaces of preselected cutter elements 70, 80. All cutter elements in a given row may not be required to have a coating of super abrasive. In many instances, the desired improvements in wear resistance, bit life and durability may be achieved where only every other insert in the row, for example, includes the coating.

Super abrasives are significantly harder than cemented tungsten carbide. Because of this substantial difference, the hardness of super abrasives is not usually expressed in terms of Rockwell A (HRa). As used herein, the term "super abrasive" means a material having a hardness of at least 2,700 Knoop (kg/mm$^2$). PCD grades have a hardness range of about 5,000–8,000 Knoop (kg/mm$^2$) while PCBN grades have hardnesses which fall within the range of about 2,700–3,500 Knoop (kg/mm$^2$). By way of comparison, the hardest grade of cemented tungsten carbide identified in Tables 3–5 has a hardness of about 1475 Knoop (kg/mm$^2$).

Certain methods of manufacturing cutter elements 70, 80 with PDC or PCBN coatings are well known. Examples of these methods are described, for example, in U.S. Pat. Nos. 4,604,106, 4,629,373, 4,694,918 and 4,811,801, the disclosures of which are all incorporated herein by this reference. Cutter elements with coatings of such super abrasives are commercially available from a number of suppliers including, for example, Smith Sii Megadiamond, Inc., General Electric Company, DeBeers Industrial Diamond Division, or Dennis Tool Company. Additional methods of applying super abrasive coatings also may be employed, such as the methods described in the co-pending U.S. patent application titled "Method for Forming a Polycrystalline Layer of Ultra Hard Material," Ser. No. 08/568,276, filed Dec. 6, 1995 and assigned to the assignee of the present invention, the entire disclosure of which is also incorporated herein by this reference.

Typical PCD coated inserts of conventional bit designs are about 10 to 1000 times more wear resistant than cemented tungsten carbide depending, in part, on the test methods employed in making the comparison. The use of PCD coatings on inserts has, in some applications, significantly increased the ability of a bit to maintain full gage, and therefore has increased the useful service life of the bit. However, some limitations exist. Typical failure modes of PCD coated inserts of conventional designs are chipping and spalling of the diamond coating. These failure modes are primarily a result of cyclical loading, or what is characterized as a fatigue mechanism.

The fatigue life, or load cycles until failure, of a brittle material like a PCD coating is dependent on the magnitude of the load. The greater the load, the fewer cycles to failure.

Conversely, if the load is decreased, the PCD coating will be able to withstand more load cycles before failure will occur.

Since the gage and off-gage insets 70, 80 of the present invention cooperatively cut the corner of the borehole, the loads (wear, frictional heat and impact) from the cutting action is shared between the gage and off-gage inserts. Therefore, the magnitude of the resultant load applied to the individual inserts is significantly less than the load that would otherwise be applied to a conventional gage insert such as insert 100 of the bit of FIG. 6 which alone was required to perform the corner cutting duty. Since the magnitude of the resultant force is reduced on cutter elements 70, 80 in the present invention, the fatigue life, or cycles to failure of the PCD coated inserts is increased. This is an important performance improvement of the present invention resulting in improved durability of the gage (a more durable gage gives better ROP potential, maintains directional responsiveness during directional drilling, allows longer bearing life, etc.) and an increase in the useful service life of the bit. Also, it expands the application window of the bit to drill harder rock which previously could not be economically drilled due to limited fatigue life of the PCD on conventional gage row inserts. When employing super abrasive coatings on inserts 70, 80 of the invention, it is preferred that the super abrasive be applied over the entire cutting portion of the insert. That is, the entire surface of the insert that extends beyond the cylindrical case portion is preferably coated. By covering the entire cutting portion of the insert, the super abrasive coating is more resistant to chipping or impact damage than if only a portion of the cutting surface were coated. The term "fully capped" as used herein means an insert whose entire cutting portion is coated with super abrasive.

Employing PCD coated inserts in the gage row 70*a,* or in the first inner row 80*a,* or both, has additional significant benefits over conventional bit designs, benefits arising from the superior wear resistance and thermal conductivity of PCD relative to tungsten carbide. PCD has about 5.4 times better thermal conductivity than tungsten carbide. Therefore, PCD conducts the frictional heat away from the cutting surfaces of cutter elements 70, 80 more efficiently than tungsten carbide, and thus helps prevent thermal fatigue or thermal degradation.

PCD starts degrading around 700EC. PCBN is thermally stable up to about 1300EC. In applications with extreme frictional heat from the cutting action, or/and in applications with high formation temperatures, such as drilling for geothermal resources, using PCBN coatings on the gage row cutter elements 70 in a bit 10 of the present invention could perform better than PCD coatings.

The strength of PCD is primarily a function of diamond grain size distribution and diamond to diamond bonding. Depending upon the average size of the diamond grains, the range of grain sizes, and the distribution of the various grain sizes employed, the diamond coatings may be made so as to have differing functional properties. A PCD grade with optimized wear resistance will have a different diamond grain size distribution than a grade optimized for increased toughness.

The following table shows three categories of diamond coatings presently available from Smith Sii MegaDiamond Inc.

TABLE 6

| Designation | Average Diamond Grain Size Range (μm) | Rank Wear Resistance* | Rank Strength or Toughness* | Rank Thermal Stability* |
|---|---|---|---|---|
| D4 | <4 | 1 | 3 | 3 |
| D10 | 4–25 | 2 | 2 | 2 |
| D30 | >25 | 3 | 1 | 1 |

*A ranking of "1" being highest and "3" the lowest.

In abrasive formations, and particularly in medium and medium to hard abrasive formations, bit 10 of the present invention may include gage inserts 70 having a cutting surface with a coating of super abrasives. For example, all or a selected number of gage inserts 70 may be coated with a high wear resistant PCD grade having an average grain size range of less than 4 Fm. Alternatively, depending upon the application, the PCD grade may be optimized for toughness, having an average grain size range of larger than 25 Fm. These coatings will enable the preselected gage insert 70 to withstand abrasion better than a tungsten carbide insert that does not include the super abrasive coating, and will permit the cutting structure of bit 10 to retain its original geometry longer and thus prevent reduced ROP and possibly a premature or unnecessary trip of the drill string. Given that gage inserts 70 having such coating will be slower to wear, off-gage inserts 80 will be better protected from the sidewall loading that would otherwise be applied to them if gage inserts 70 were to wear prematurely. Furthermore, with super abrasive coating on inserts 70, off-gage inserts 80 may be made with longer extensions or with more aggressive cutting shapes, or both (leading to increased ROP potential) than would be possible if off-gage inserts 80 had to be configured to be able to bear sidewall cutting duty after gage inserts 70 (without a super abrasive coating) wore due to abrasion and erosion.

In some soft or soft to medium hard abrasive formations, such as silts and sandstones, or in formations that create high thermal loads, such as claystones and limestones, conventional gage inserts 100 (FIG. 6) of cemented tungsten carbide have typically suffered from thermal fatigue, which has lead to subsequent gage insert breakage. According to the present invention, it is desirable in, such formations to include a super abrasive coating on certain or all of the off-gage inserts 80 of bit 10 to resist abrasion, to maintain ROP, and to increase bit life. However, because first inner row inserts 80 in this configuration must be able to withstand some impact loading, the most wear resistant super abrasive material is generally not suitable, the application instead requiring a compromise in wear resistance and toughness. A suitable diamond coating for off-gage insert 80 in such an application would have relatively high toughness and relatively lower wear resistance and be made of a diamond grade with average grain size range larger than 25 Fm. Gage insert 70 in this example could be manufactured without a super abrasive coating, and preferably would be made of a finer grained cemented tungsten carbide grade having a nominal hardness of 90.8 HRa and a cobalt content of 6% by weight. Gage inserts 70 of such a grade of tungsten carbide exhibit 2.5 times the nominal resistance and have significantly better thermal stability than inserts formed of a grade having a nominal hardness 88.8 HRa and cobalt content of about 11%, a typical grade for conventional gage inserts 100 such as shown in FIG. 6. Where gage inserts 70 are mounted between inserts 80 along circumferential shoulder 50 in the configuration shown in FIGS. 1–4, inserts 70 of this example are believed capable of resisting wear and thermal loading in these formations even without a super abrasives coating. Also, applying a PCD or PCBN coating on gage inserts 70 may be undesirable in bits employed when drilling high inclination wells with steerable drilling systems due to potentially severe impact loads experienced by the gage inserts 70 as the drill string is rotated within the well casing—loading that would not be exposed by the more protected inner row off-gage cutter elements 80.

The present invention also contemplates constructing bit 10 with preselected gage inserts 70 and off-gage inserts 80 each having coatings of super abrasive material. In certain extremely hard and abrasive formations, both gage inserts 70 and off-gage inserts 80 may include the same grade of PCD coating. For example, in such formations, the preselected inserts 70, 80 may include extremely wear resistant coatings such as a PCD grade having an average grain size range of less than 4 Fm. In other formations that tend to cause high thermal loading on the inserts, such as soft and medium soft abrasive formations like silt, sandstone, limestone and shale, a coating of super abrasive material having high thermal stability is important. Accordingly, in such formations, it may be desirable to include coatings on inserts 70 and 80 that have greater thermal stability than the coating described above, such as coatings having an average grain size range of 4–25 Fm.

In drilling direction wells through abrasive formations having varying compressive strengths (nonhomogeneous abrasive formations), it may be desirable to include super abrasive coatings on both gage inserts 70 and off-gage inserts 80. In such applications, off-gage inserts 80, for example, may be subjected to a more severe impact loading than gage inserts 70. In this instance, it would be desirable to include a tougher or more impact resistant coating on off-gage insert 80 than on gage inserts 70. Accordingly, in such an application, it would be appropriate to employ a diamond coating on insert 80 having an average grain size range of greater than 25 Fm, while gage insert 70 may employ more wear resistant, but not as tough diamond coating, such as one having an average grain size within the range of 4–25 Fm or smaller.

Optimization of cutter element materials in accordance with the present invention is further illustrated by the Examples set forth below. The Examples are illustrative, rather than inclusive, of the various permutations that are considered to fall within the scope of the present invention.

EXAMPLE 1

A rolling cone cutter such as cutter 14 shown in FIGS. 1–4 is provided with both gage and off-gage inserts 70, 80 consisting of uncoated tungsten carbide. The gage inserts 70 have a nominal hardness in the range of 88.8 to at least 90.8 HRa and cobalt content in the range of about 11 to about 6 weight percent, while the first inner row inserts 80 have a nominal hardness in the range of 85.8 to 88.8 HRa and cobalt content in the range of about 16 to about 10 weight percent. Comparing the nominal wear resistances of a cemented tungsten carbide grade having a nominal hardness of 89.4 HRa and one having a nominal hardness of 88.8 HRa as might be employed in the gage row 70*a* and first inner row 80*a,* respectively, in the above example, the wear resistance of the gage elements 70 would exceed that of the off gage element 80 by about 48%. A most preferred embodiment of this example, however has inserts 70 in the gage row 70*a* with a nominal hardness of 90.8 HRa and cobalt content of about 6 percent and inserts 80 in the off-gage row 80*a* with a nominal hardness of 87.4 HRa and cobalt content of about 12 percent, such that gage inserts 70 are more than three times as wear resistant as off-gage inserts 80, but where off-gage inserts 80 are more than 30% tougher than gage inserts 70.

EXAMPLE 2

A rolling cone cutter such as cutter 14 as shown in FIGS. 1–4 is provided with PCD-coated gage inserts 70 and off-gage inserts 80 consisting of uncoated tungsten carbide. The coating on the gage inserts 70 may be any suitable PCD coating, while the inserts 80 in the off-gage row 80*a* have a nominal hardness in the range of 85.8 to 88.8 HRa and cobalt content in the range of about 16 to about 10 weight percent. The most preferred embodiment of this example has inserts 80 in the off-gage row with a nominal hardness of 87.4 to 88.1 HRa and cobalt content in the range of about 12 to about 10 weight percent.

EXAMPLE 3

A rolling cone cutter such as cutter 14 as shown in FIGS. 1–4 is provided with PCD-coated gage inserts 70 and off-gage inserts 80. The coating on the gage inserts 70 or off-gage inserts 80 may be any suitable PCD coating. In a preferred embodiment of this example, the coating on the gage inserts 70 is optimed for wear resistance and has an average grain size range of less than or equal to 25 Fm. The PCD coating on the off-gage inserts 80 is optimized for toughness and preferably has an average grain size range of greater than 25 $\mu$m.

EXAMPLE 4

A rolling cone cutter such as cutter 14 as shown in FIGS. 1–4 is provided with gage inserts 70 of uncoated tungsten carbide and off-gage inserts 80 coated with a suitable PCD coating. The gage inserts 70 have a nominal hardness in the range of 89.4 to 90.8 HRa and cobalt content in the range of about 11 to about 6 weight percent. The most preferred embodiment of this example has gage inserts 70 with a nominal hardness of 90.8 HRa and cobalt content about 6 percent and off-gage inserts 80 having a coating optimized for toughness and preferably having an average grain size range of greater than 25 $\mu$m.

Although the invention has been described with reference to the currently-preferred and commercially available grades or classifications tungsten carbide and PDC coatings, it should be understood that the substantial benefits provided by the invention may be obtained using any of a number of other classes or grades of carbide and PCD coatings. What is important to the invention is the ability to vary the wear resistance, thermal stability and toughness of cutter elements 70, 80 by employing carbide cutter elements and diamond coatings having differing compositions. Advantageously then, the principles of the present invention may be applied using even more wear resistant or tougher tungsten carbide PCD or PCBN surfaces as they become commercially available in the future.

Figure 13:
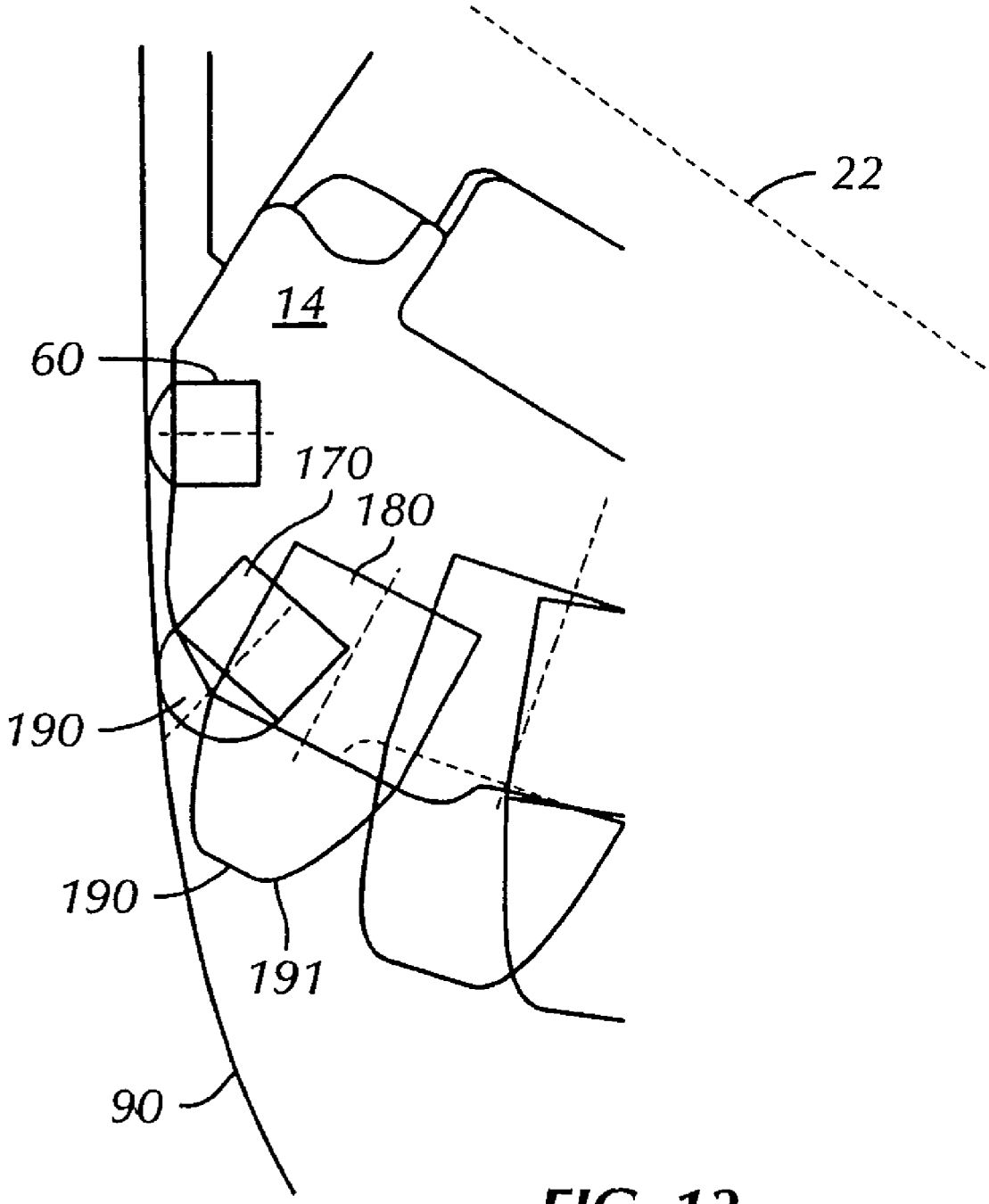
FIG. 13 is a view similar to FIG. 4 showing another alternative embodiment of the invention.
Figure 14:
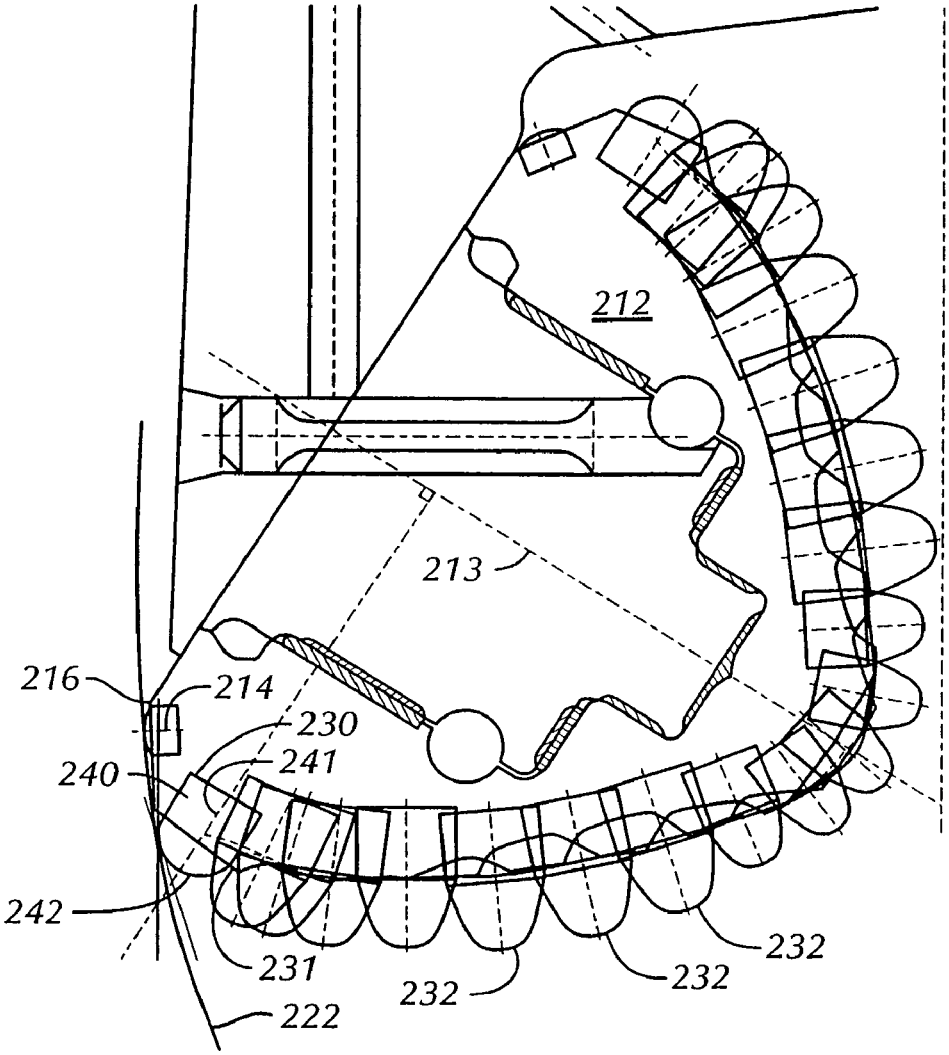
FIG. 14 is a side schematic view of one leg and one rolling cone cutter of a rolling cone bit constructed according to the prior art.
Figure 15:
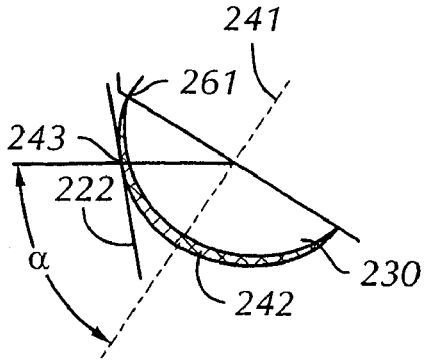
FIG. 15 is an enlarged view of the gage insert of FIG. 14.

Optimizing the placement and material combinations for gage inserts 70 and off-gage inserts 80 allows the use of more aggressive cutting shapes in gage rows 70*a* and off-gage rows 80*a* leading to increased ROP potential. Specifically, it is advantageous to employ chisel-shaped cutter elements in one or both of gage row 70*a* and off-gage row 80*a*. Preferred chisel cutter shapes include those shown and described in U.S. Pat. No. 5,172,777, 5,322,138 and 4,832,139, the disclosures of which are all incorporated herein by this reference. A chisel insert presently-preferred for use in bit 10 of the present invention is shown in FIG. 13. As shown, both gage insert 170 and off-gage insert 180 are sculptured chisel inserts having no non-tangential intersections of the cutting surfaces and having an inclined crest 190. The inserts 170, 180 are oriented such that the crests 190 are substantially parallel to cone axis 22 and so that the end 191 of the crest that extends furthest from cone axis 22 is closest to the bit axis 11. Crest 190 of gage insert 170 extends to gage curve 90, while the insert 190 of insert 180 is off gage by a distance D previously described.

The cutting surfaces of these inserts 170, 180 may be formed different grades of cemented tungsten carbide or may have super abrasive coatings in various combinations, all as previously described above. In most instances, gage insert 170 will be more wear-resistance than off-gage insert 180. Inserts 170, 180 having super abrasive coatings should be fully capped.

EXAMPLE 5

A particularly desirable combination employing chisel inserts in rows 70*a* and 80*a* include gage insert 170 having a PCD coating with an average grain size of less than or equal to 25 Fm and an off-gage insert 180 of cemented tungsten carbide having a nominal hardness of 88.1 HRa. Where greater wear-resistance is desired for gage row 80*a*, insert 180 shown in FIG. 13 may instead be coated with a PCD coating such as one having an average grain size greater than 25 Fm. From the preceding description, it will be apparent to those skilled in the art that a variety of other combinations of tungsten carbide grades and super abrasive coatings may be employed advantageously depending upon the particular formation being drilled and drilling application being applied.

Figure 10:
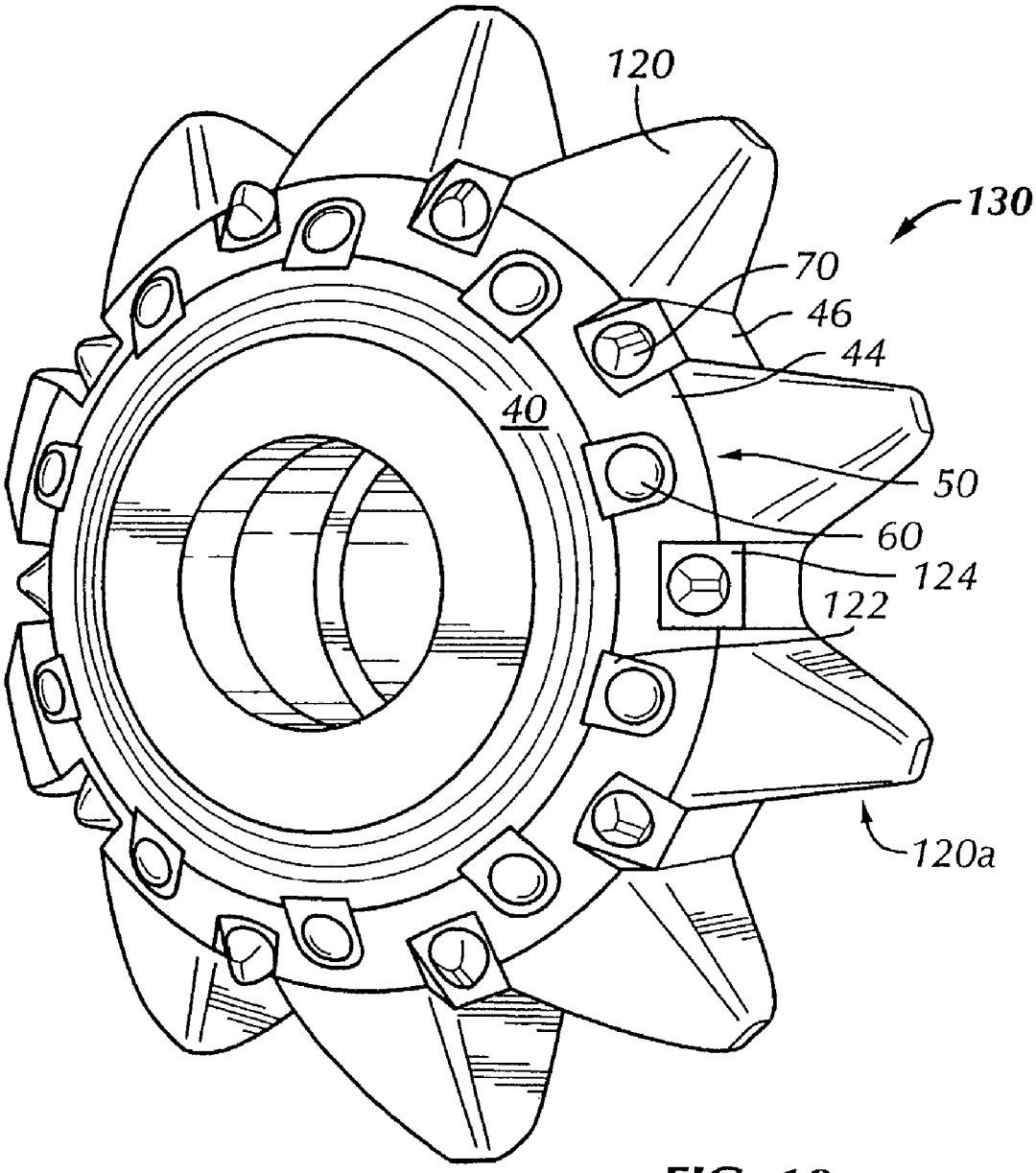
FIG. 10 is a perspective view of a steel tooth cutter showing an alternative embodiment of the present invention.
Figure 11:
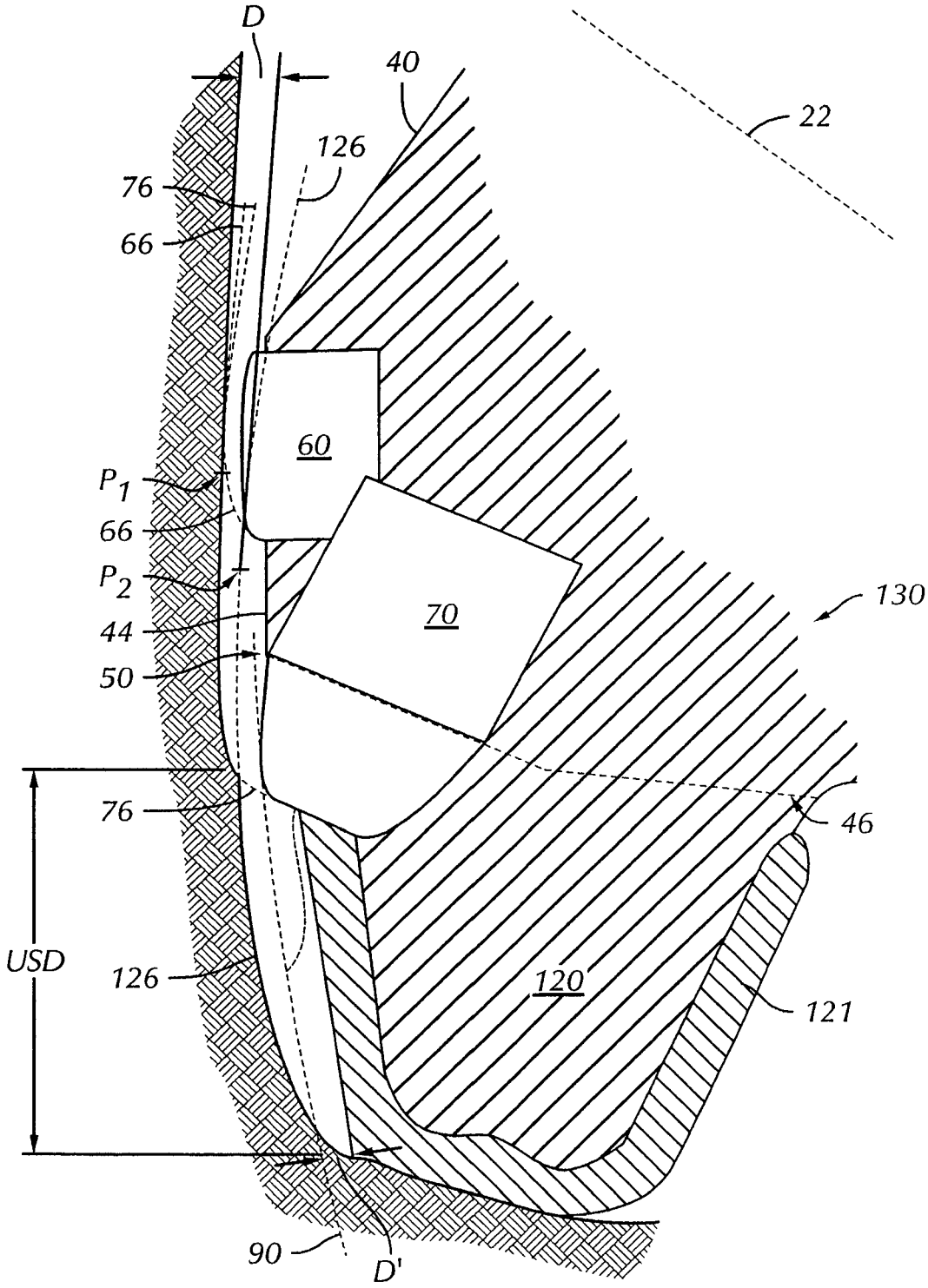
FIG. 11 is an enlarged cross-sectional view similar to FIG. 4, showing a portion of the cutting structure of the steel tooth cutter shown in FIG. 10.

The present invention may be employed in steel tooth bits as well as TCI bits as will be understood with reference to FIG. 10 and 11. As shown, a steel tooth cone 130 is adapted for attachment to a bit body 12 in a like manner as previously described with reference to cones 14–16. When the invention is employed in a steel tooth bit, the bit would include a plurality of cutters such as rolling cone cutter 130. Cutter 130 includes a backface 40, a generally conical surface 46 and a heel surface 44 which is formed between conical surface 46 and backface 40, all as previously described with reference to the TCI bit shown in FIGS. 1–4. Similarly, steel tooth cutter 130 includes heel row inserts 60 embedded within heel surface 44, and gage row cutter elements such as inserts 70 disposed adjacent to the circumferential shoulder 50 as previously defined. Although depicted as inserts, gage cutter elements 70 may likewise be steel teeth or some other type of cutter element. Relief 122 is formed in heel surface 44 about each insert 60. Similarly, relief 124 is formed about gage cutter elements 70, relieved areas 122, 124 being provided as lands for proper mounting and orientation of inserts 60, 70. In addition to cutter elements 60, 70, steel tooth cutter 130 includes a plurality of first inner row cutter elements 120 generally formed as radially-extending teeth. Steel teeth 120 include an outer layer or layers of wear resistant material 121 to improve durability of cutter elements 120.

In conventional steel tooth bits, the first row of teeth are integrally formed in the cone cutter so as to be "on gage." This placement requires that the teeth be configured to cut the borehole corner without any substantial assistance from any other cutter elements, as was required of gage insert 100 in the prior art TCI bit shown in FIG. 6. By contrast, in the present invention, cutter elements 120 are off-gage within the ranges specified in Table 2 above so as to form the first inner row of cutter elements 120*a*. In this configuration, best shown in FIG. 11, gage inserts 70 and first inner row cutter elements 120 cooperatively cut the borehole corner with gage inserts 70 primarily responsible for sidewall cutting and with steel teeth cutter elements 120 of the first inner row primarily cutting the borehole bottom. As best shown in FIG. 11, as the steel tooth bit forms the borehole; gage inserts 70 cut along path 76 having a radially outermost point $P_1$. Likewise, inner row cutter element 120 cuts along the path represented by curve 126 having a radially outermost point $P_2$. As described previously with reference to FIG. 4, the distance D that cutter elements 120 are "off-gage" is the difference in radial distance between $P_1$ and $P_2$. The distance that cutter elements 120 are "off-gage" may likewise be understood as being the distance D which is the minimum distance between the cutting surface of cutter element 120 and the gage curve 90 shown in FIG. 11, D being equal to D.

Steel tooth cutters such as cutter 130 have particular application in relatively soft formation materials and are preferred over TCI bits in many applications. Nevertheless, even in relatively soft formations, in prior art bits in which the gage row cutters consisted of steel teeth, the substantial sidewall cutting that must be performed by such steel teeth may cause the teeth to wear to such a degree that the bit becomes undersized and cannot maintain gage. Additionally, because the formation material cut by even a steel tooth bit frequently includes strata having various degrees of hardness and abrasiveness, providing a bit having insert cutter elements 70 on gage between adjacent off-gage steel teeth 120 as shown in FIGS. 10 and 11 provides a division of corner cutting duty and permits the bit to withstand very abrasive formations and to prevent premature bit wear. Other benefits and advantages of the present invention that were previously described with reference to a TCI bit apply equally to steel tooth bits, including the advantages of employing materials of differing hardness and toughness for gage inserts 70 and off-gage steel teeth 120. Optimization of cutter element materials in steel tooth bits is further described by the illustrative examples set forth below.

EXAMPLE 6

A steel tooth bit having a cone cutter 130 such as shown in FIG. 11 is provided with gage row inserts 70 of tungsten carbide with a nominal hardness within the range of 88.1–90.8 HRa and cobalt content in the range of about 11 to about 6% by weight. Within this range, it is preferred that gage inserts 70 have a nominal hardness within the range of 89.4 to 90.8 HRa. Off-gage teeth 120 include an outer layer of conventional wear resistant hardfacing material such as tungsten carbide and metallic binder compositions to improve their durability.

EXAMPLE 7

A steel tooth bit having a cone cutter 130 such as shown in FIG. 11 is provided with tungsten carbide gage row inserts 70 having a coating of super abrasives of PCD or PCBN. Where PCD is employed, the PCD has an average grain size that is not greater than 25 Fm. Off-gage steel teeth 120 include a layer of conventional hardfacing material.

Figure 12:
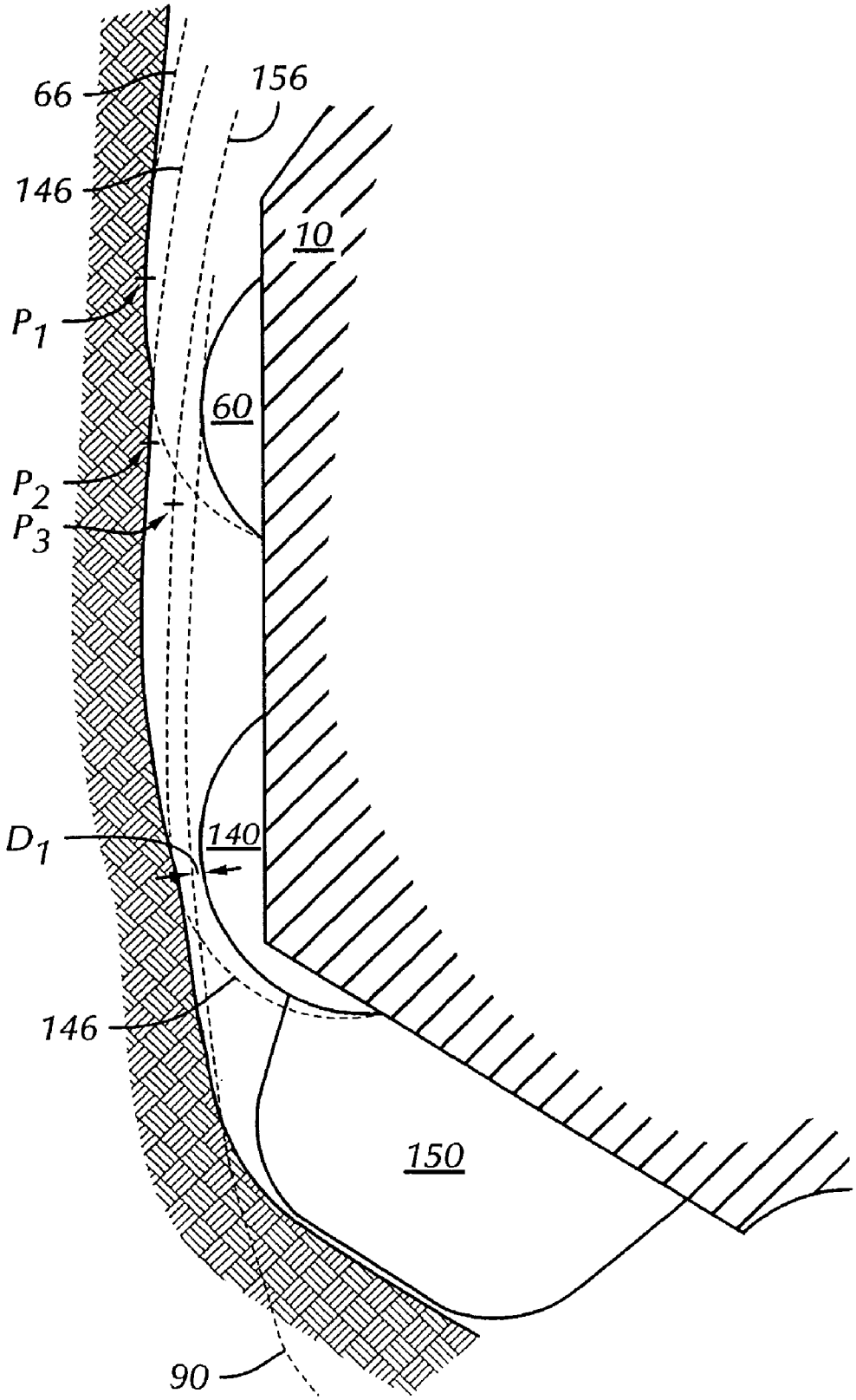
FIG. 12 is a view similar to FIG. 4 showing another alternative embodiment of the invention.

Although in the preferred embodiments described thus far, the cutting surfaces of cutter elements 70 extend to full gage diameter, many of the substantial benefits of the present invention can be achieved by employing a pair of closely spaced rows of cutter elements that are positioned to share the borehole corner cutting duty, but where the cutting surfaces of the cutter elements of each row are off-gage. Such an embodiment is shown in FIG. 12 where bit 10 includes a heel row of cutter elements 60 which have cutting surfaces that extend to full gage and that cut along curve 66 which includes a radially most distant point $P_1$ as measured from bit axis 11. The bit 10 further includes a row of cutter elements 140 that have cutting surfaces that cut along curve 146 that includes a radially most distant point $P_2$. Cutter elements 140 are positioned so that their cutting surfaces are off-gage a distance $D_1$ from gage curve 90, where $D_1$ is also equal to the difference in the radial distance between point $P_1$ and $P_2$ as measured from bit axis 11. As shown in FIG. 12, bit 10 further includes a row of off-gage cutter elements 150 that cut along curve 156 having radially most distant point $P_3$. $D_2$ (not shown in FIG. 12 for clarity) is equal to the difference in radial distance between points $P_2$ and $P_3$ as measured from bit axis 11. In this embodiment, $D_2$ should be selected to be within the range of distances shown in Table 2 above. $D_1$ may be less than or equal to $D_2$, but preferably is less than $D_2$. So positioned, cutter elements 140, 150 cooperatively cut the borehole corner, with cutter elements 140 primarily cutting the borehole sidewall and cutter elements 150 primarily cutting the borehole bottom. Heel cutter elements 60 serve to ream the borehole to full gage diameter by removing the remaining uncut formation material from the borehole sidewall.

Figure 16:
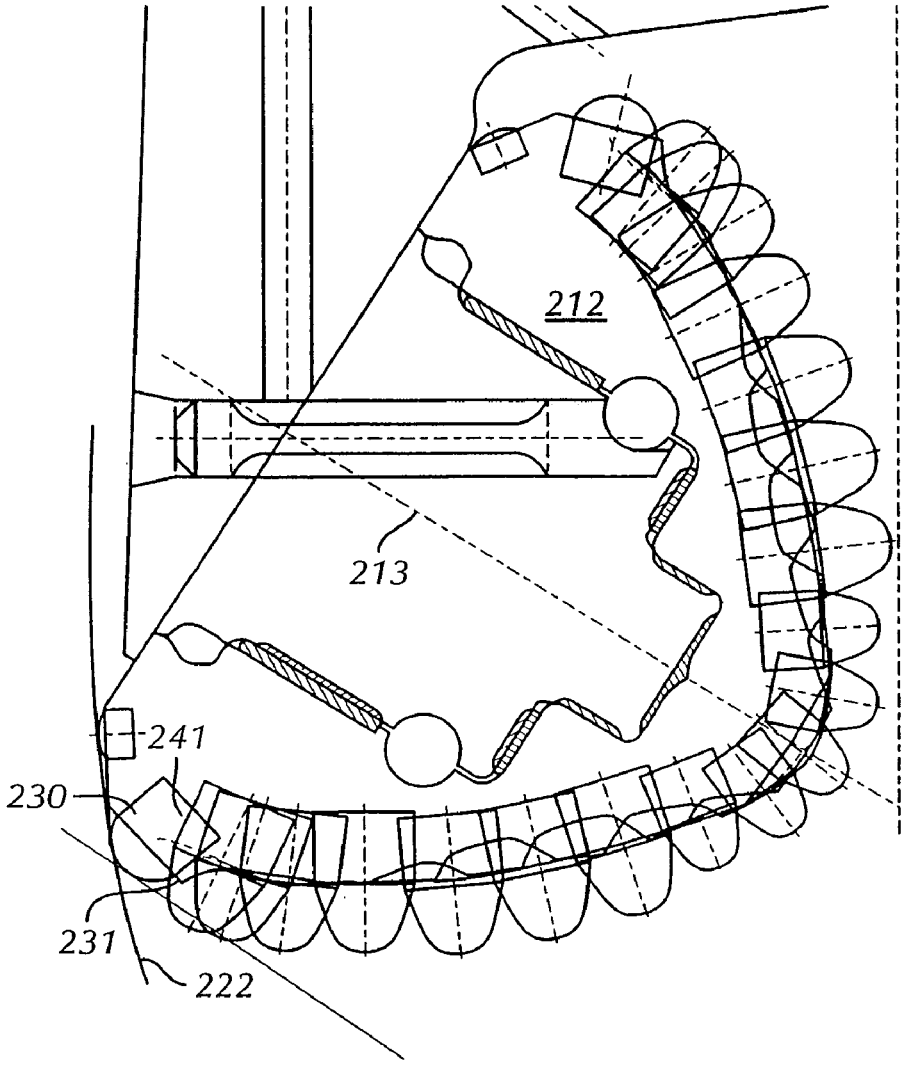
FIG. 16 is a side schematic view of one leg and one rolling cone cutter of a rolling cone bit constructed in accordance with a first embodiment of the present invention.
Figure 17:
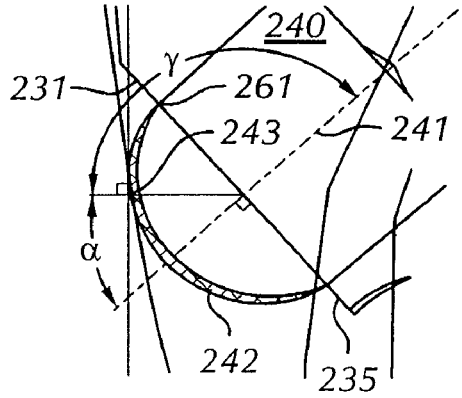
FIG. 17 is an enlarged view of the gage insert of FIG. 16.

Referring now to FIGS. 16 and 17, according to one embodiment of the present invention, each gage cutter insert 230 is repositioned such that its axis 241 is no longer perpendicular to the cone axis 213. Instead, the axis 241 of each gage cutter insert is rotated around the center of its hemispherical top such that its base is shifted toward the tip of the cone 212 and its axis 241 is more normal to gage curve 222. Rotation in this manner has the desired effect of moving contact point 243 away from the edge 261 of diamond layer 242. Because the insert is rotated about the center of its hemispherical top, the gage curve 222 remains tangential to the surface of the insert and the cutting load is not altered.

Surface 231, which defines a land 235 around each insert, is reshaped so that it remains perpendicular to axis 241. Modification of surface 231 in this manner is preferred because it provides better support for each cutter and because it is generally easier to carry out the drilling and press-fitting manufacturing steps when the hole into which the insert is set is perpendicular to the land surface. Moreover, it allows all of the grip on base 240 to be maintained while also allowing the extension portion of cutter element 230 to be unchanged.

According to one preferred embodiment, axis 241 is rotated until the angle $\alpha$ is between 0° and 50°, and more preferably is no more than 40°. It would be preferable to reduce $\alpha$ to 0, if possible, but rotation of axis 241 is limited by geometry of the cone. That is, either the clearance between the bottom of an insert in the gage row and an insert in the next, inner row becomes inadequate to retain the insert, or the holes for adjacent inserts run into each other. Thus, it is generally preferable to keep $\alpha$ in the range of about 25° to 55°.

Figure 18:
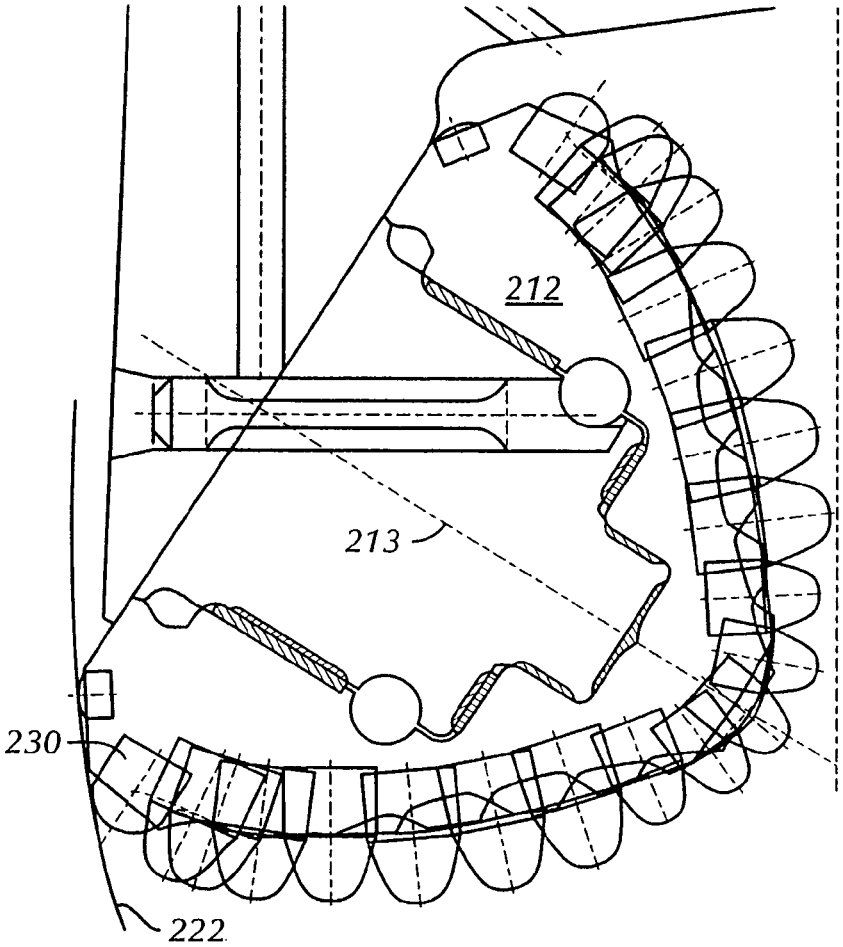
FIG. 18 is a side schematic view of one leg and one rolling cone cutter of a rolling cone bit constructed in accordance with a second embodiment of the present invention.
Figure 19:
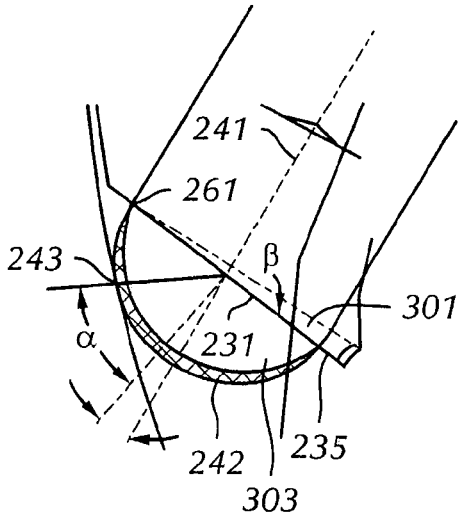
FIG. 19 is an enlarged view of the gage insert of FIG. 18.

Referring now to FIGS. 18 and 19, according to another embodiment of the present invention, each gage cutter insert 230 is reconfigured such that the center point of its diamond insert layer 242 no longer coincides with axis 241. Instead, diamond layer 242 and the axisymmetric SRT cutting surface defined thereby are canted with respect to axis 241 such that the thickest portion of diamond layer 242 is closer to the gage curve 222. Canting the SRT 303 in this manner has the desired effect of moving contact point 243 away from the edge 261 of diamond layer 242. It is preferred but not necessary that the thickest portion of diamond layer 242 be between axis 241 and contact point 243.

Cone surface 231 is reshaped so that each land 235 remains aligned with the lower edge of the SRT. Thus, in this embodiment, surface 231 is no longer perpendicular to axis 241. Modification of surface 231 in this manner allows the amount of extension of insert 230 to remain unchanged. While the hole into which insert 230 is pressfit is no longer perpendicular to surface 231, this method has the advantage of maintaining a larger clearance between the base of each gage insert and the bases of adjacent inserts.

According to a preferred embodiment, the center point of the diamond layer 242 is shifted until the angle $\beta$ (FIG. 19), defined as the angle between axis 241 of insert 230 and a radius through the thickest portion of diamond layer 242, is at least 5°, and more preferably at least 10°. It is not typically possible to cant the SRT by more than about 45°. Canting the SRT results in $\alpha$ being reduced by an amount approximately equal to $\beta$ so that $\alpha$ preferably ranges from about 25° to about 55°.

When SRT 303, which extends outward from land 235, is canted, a wedge-shaped portion 301 is defined between SRT 303 and the cylindrical portion of base 240. Because both SRT 303 and the base portion 240 have circular cross-sections with substantially the same diameter, the outer surface of wedge-shaped portion 301 forms a transition between the surface of base 240 and the surface of SRT 303.

Figure 20:
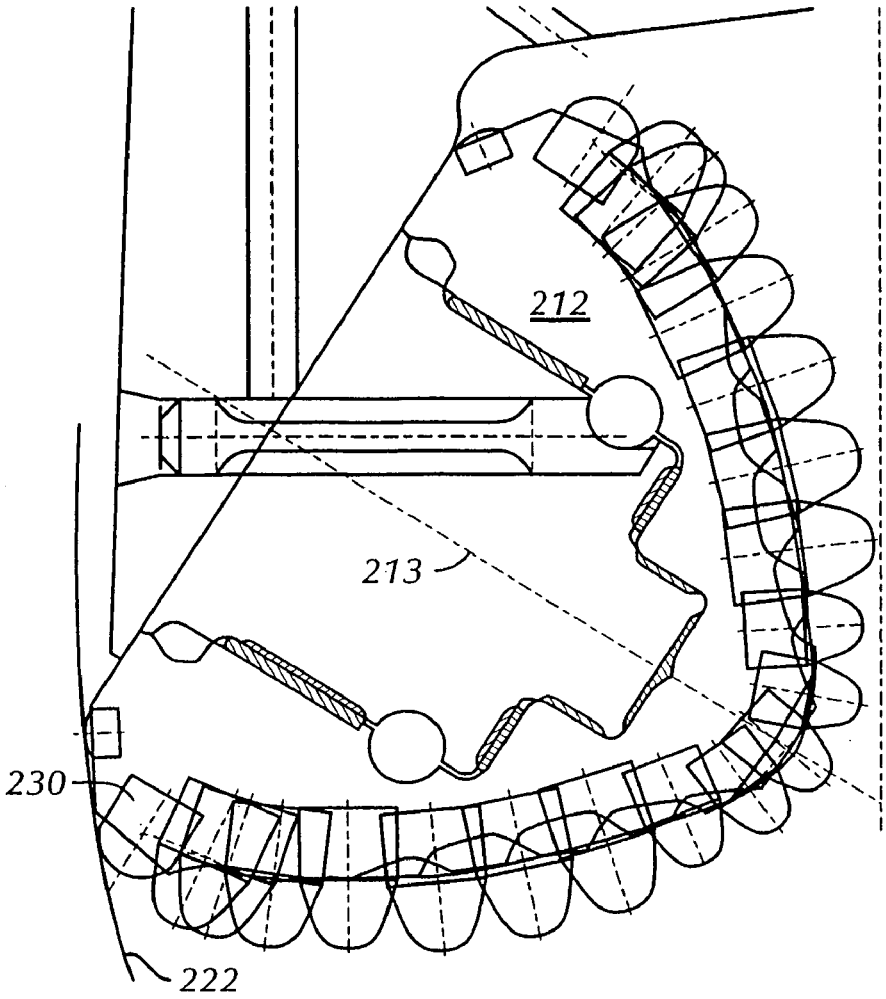
FIG. 20 is a side schematic view of one leg and one rolling cone cutter of a rolling cone bit constructed in accordance with a alternative embodiment of the device of FIG. 18.
Figure 21:
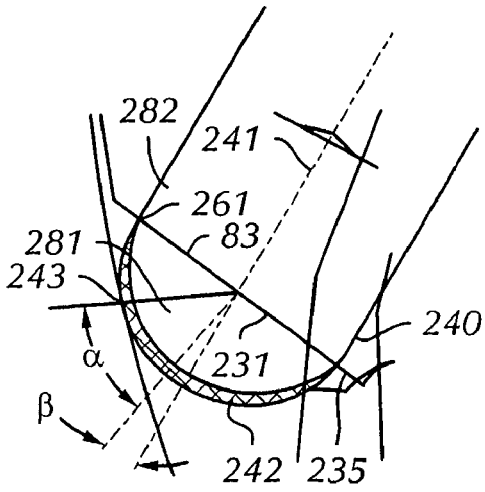
FIG. 21 is an enlarged view of the gage insert of FIG. 20.

Referring now to FIGS. 20 and 21, an alternative embodiment of the insert shown in FIGS. 18 and 19 again comprises an insert having a canted SRT. In this embodiment, however, the outer surface of base 240 is maintained as a right cylinder and the geometry of the SRT is re-shaped so as to conform to the outer surface of base 240. Thus, the footprint of the diamond enhanced portion becomes an, ellipse, rather than a circle, with its minor diameter equal to the diameter of base 240 and its major diameter equal to the diameter of base 240 divided by the cosine of $\alpha$ and cutting portion of insert 230 is no longer axisymmetric.

Figure 22:
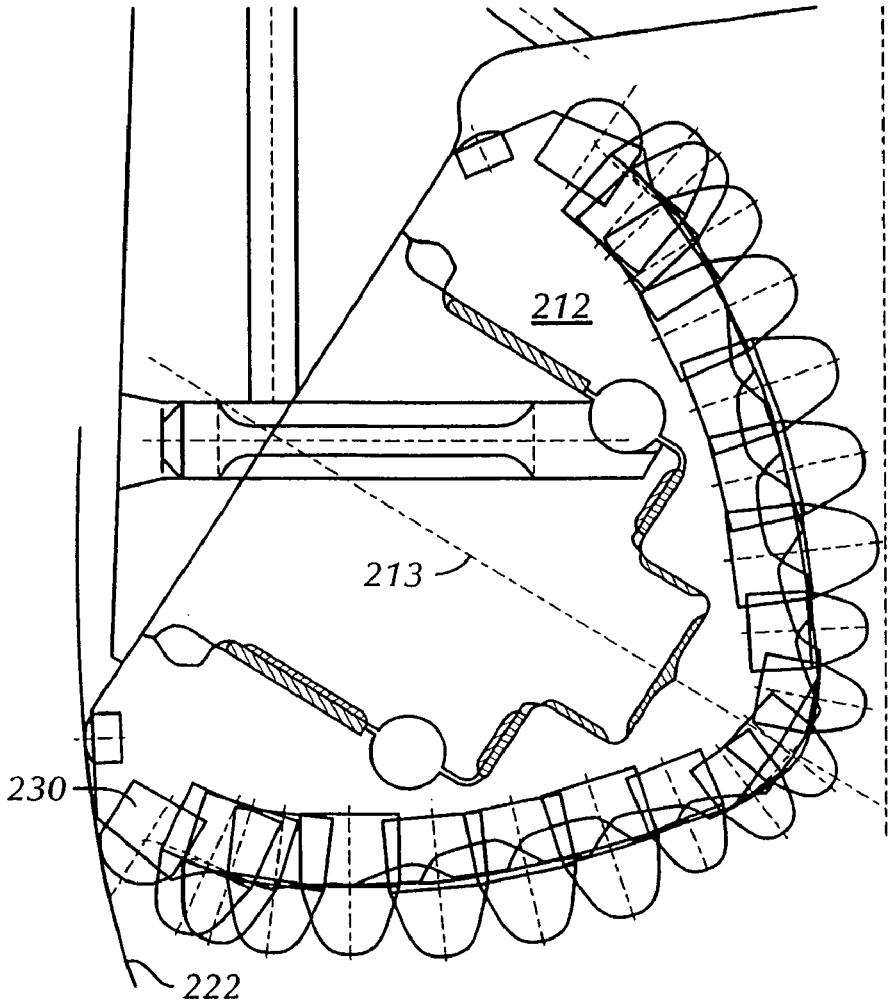
FIG. 22 is a side schematic view of one leg and one rolling cone cutter of a rolling cone bit constructed in accordance with a third embodiment of the present invention.
Figure 23:
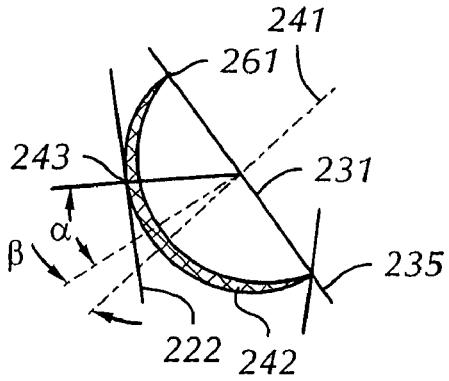
FIG. 23 is an enlarged view of the gage insert of FIG. 22.

Referring now to FIGS. 22 and 23, according to another embodiment of the present invention, the concepts described with respect to FIGS. 16–21 above are combined. In this embodiment, the axis 241 of each gage cutter insert 230 is rotated around the center of its hemispherical top and each gage cutter insert 230 is reconfigured such that the center point of its diamond insert layer 242 no longer coincides with axis 241. Together these modifications preferably result in a reduction of $\alpha$ to a range of about 15° to about 45°. For a typical 12¼" rock bit, $\alpha$ may be about 29° in this embodiment.

Figure 24:
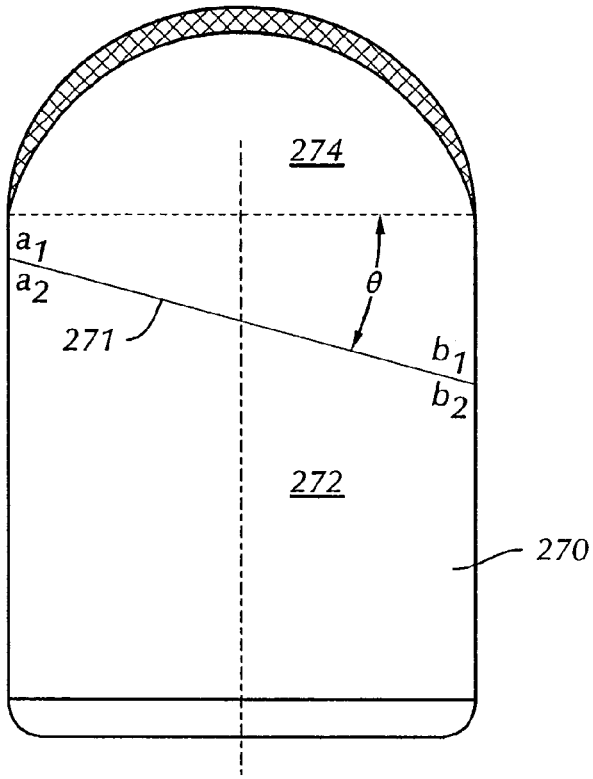
FIGS. 24 and 25 are side views of a diamond enhanced insert, showing one technique for constructing an insert having a canted diamond layer.
Figure 25:
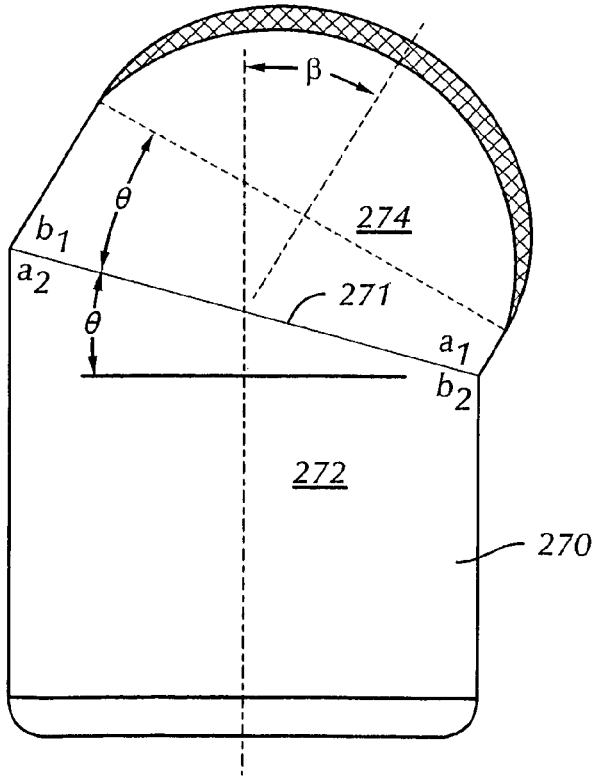

Referring now to FIGS. 24 and 25, one technique for creating an insert having a canted diamond layer is to form an axisymmetric diamond-coated insert 270 having a cylindrical base 272. By cutting insert 270 on a plane 271 that forms an angle $\theta$ with respect to a plane perpendicular to the axis of the insert 270, a top portion 274 is generated, as shown in FIG. 24. When top portion 274 is rotated 180° and re-attached to base 272, it will be canted with respect to base 272 at an angle $\theta$ that is equal to $2\theta$.

Figure 26:
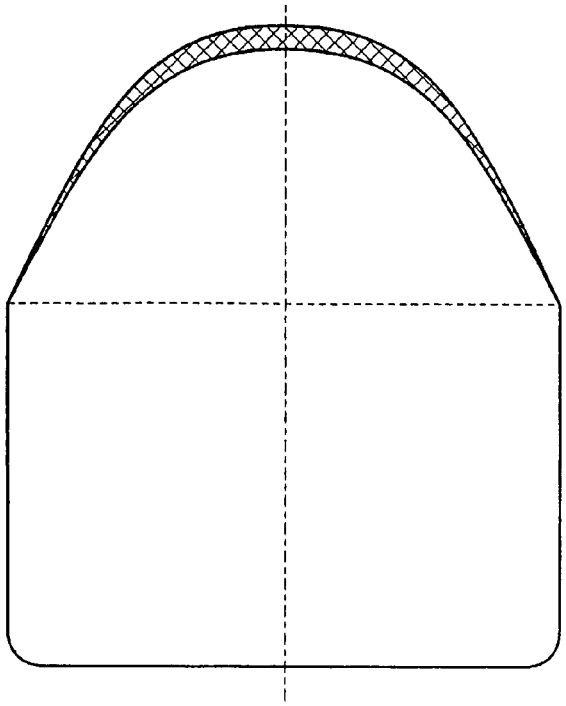
FIGS. 26 and 27 are side views of alternative axisymmetric diamond coated inserts that could be canted in accordance with the principles of the present invention.
Figure 27:
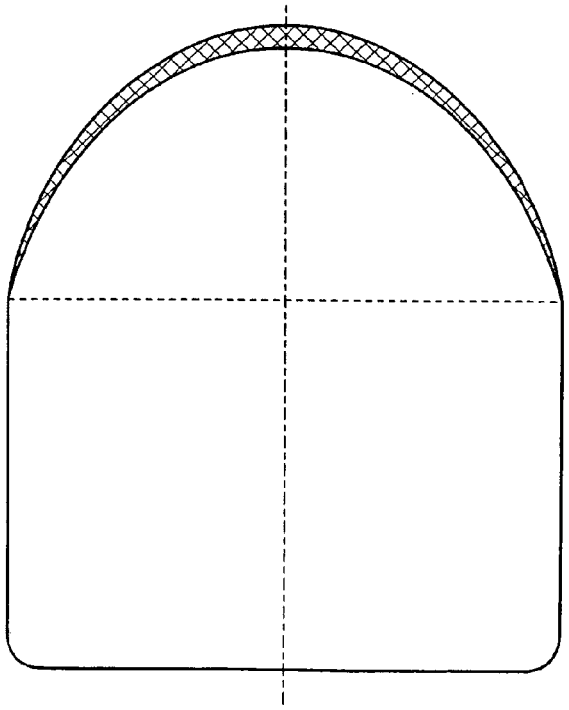

FIGS. 26 and 27 illustrate a conical insert extension and a bullet-shaped extension, respectively. Both of these axisymmetric shapes can be used in inserts having a diamond layer that is canted in accordance with the principles disclosed herein. It will be recognized that the conical insert of FIG. 26 is conical only at the lower portion of its extension, its tip being rounded to form a curved cutting surface.

It will be understood that the foregoing concepts have primary applicability to diamond enhanced inserts in the gage row. Nevertheless, some of the principles disclosed herein can be applied to inserts in other rows, such as a nestled gage row, if the configuration of the cone and borehole wall would otherwise cause each insert in that row to contact the wall at a point that is close to the edge of its diamond layer. For example, if desired, the canted SRT can be used on inserts occupying what is sometimes referred to as the nestled gage row. Likewise these concepts can be used to advantage in inserts having a non-tapered diamond layer of uniform thickness. Such inserts tend to be prone to cracking near the edge of the diamond layer, so that moving the contact point away from the diamond edge results in a longer-lived insert.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

The invention claimed is:

1. A drill bit, comprising:

a bit body;

a plurality of roller cone cutters, each rotatably mounted on the bit body about a respective cone axis and having plurality of rows of cutting inserts thereon;

wherein at least one of the plurality of rows includes a canted insert, wherein the canted insert comprises a cutting portion and a base portion having a base axis extending through the center of the base, wherein the cutting portion is canted with respect to the base portion, such that a radius through a center point of the cutting portion forms a cant angle of at least 5 degrees with respect to the base axis.

2. The drill bit of claim 1, wherein the cant angle is between 5° and 45°.

3. A cutting element for a drill bit, comprising:

a cutting portion; and a base portion having a base axis extending through the center of the base, wherein the cutting portion is canted with respect to the base portion, such that a radius through a center point of the cutting portion forms a cant angle of at least 5 degrees with respect to the base axis.

4. The cutting element of claim 3, wherein the cant angle is between 5° and 45°.

5. A method of designing a drill bit, comprising:

selecting a formation to be drilled;

selecting at least one cutting element based on the formation to be drilled; and selecting an orientation for the at least one cutting element that is different than an orientation for at least one other cutting element, such that a potential rate of penetration of the drill bit is increased.

6. The method of claim 5, wherein the orientation is selected such that a crest of the at least one cutting element is substantially parallel to a cone axis.

7. A drill bit made according to the method of claim 5.

* * * * *